US007708513B2

(12) United States Patent
Fisher et al.

(10) Patent No.: US 7,708,513 B2
(45) Date of Patent: May 4, 2010

(54) BINDING ELEMENTS AND PLURALITY OF BINDING ELEMENTS PARTICULARLY SUITED FOR AUTOMATED PROCESSES

(75) Inventors: Mark Fisher, Highland Park, IL (US); Peter Hotkowski, Chester, CT (US); Marc Kullberg, Lisle, IL (US); Samuel Amdahl, Prospect Heights, IL (US); Frank Todaro, Old Saybrook, CT (US)

(73) Assignee: General Binding Corporation, Lincolnshire, IL (US)

( * ) Notice: Subject to any disclaimer, the term of this patent is extended or adjusted under 35 U.S.C. 154(b) by 416 days.

(21) Appl. No.: 11/462,532

(22) Filed: Aug. 4, 2006

(65) Prior Publication Data

US 2007/0031214 A1 Feb. 8, 2007

Related U.S. Application Data

(63) Continuation-in-part of application No. PCT/US2005/024620, filed on Jul. 12, 2005.

(60) Provisional application No. 60/643,009, filed on Jan. 11, 2005, provisional application No. 60/587,224, filed on Jul. 12, 2004.

(51) Int. Cl.

| | |
|---|---|
| ***B42B 5/06*** | (2006.01) |
| ***B42B 9/00*** | (2006.01) |
| ***B42F 13/06*** | (2006.01) |
| ***B42F 13/08*** | (2006.01) |
| ***A44B 1/04*** | (2006.01) |
| ***A44B 11/25*** | (2006.01) |
| ***A44B 17/00*** | (2006.01) |
| ***B42F 1/00*** | (2006.01) |

(52) U.S. Cl. ..... 412/34; 412/40; 402/14; 24/67 R; 24/67 AR

(58) Field of Classification Search ..... 402/8, 402/9, 13, 15, 19, 60, 64; 270/52.18, 58.08; 24/67 AR, 67 R, 16 PB; 412/34, 38, 40
See application file for complete search history.

(56) References Cited

U.S. PATENT DOCUMENTS 699,290 A 5/1902 Daniel (Continued)

FOREIGN PATENT DOCUMENTS

CA 509621 2/1955

(Continued)

*Primary Examiner*—Dana Ross
*Assistant Examiner*—Kyle Grabowski
(74) *Attorney, Agent, or Firm*—Michael Best & Friedrich LLP

(57) ABSTRACT

A plurality of binding elements, each of a substantially uniform thickness, the fingers being looped over and coupled to the spine such that the inner surface of the fingers is disposed against the inner surface of the spine by an adhesive when assembled. In an embodiment, at least a portion of the outer surface of the binding element is resistant to a more permanent attachment to the adhesive such that the plurality may be stacked together, and successively decoupled or removed for insertion into a stack. The binding elements may include score lines or bends in the fingers to provide a rounded closed loop structure; optional gussets in the bends inhibit straightening of the fingers. The fingers optionally include variations in cross-section along the length to relieve certain stresses to inhibit the looped finger. The binding elements optionally include structure for facilitating interaction with an automating binding process.

35 Claims, 27 Drawing Sheets

U.S. PATENT DOCUMENTS 0,754,791 A 3/1904 Mentzer
1,005,423 A 10/1911 Elder
1,119,786 A 12/1914 Morden et al.
1,343,103 A 6/1920 Wolf
1,537,675 A 5/1925 Horn
1,816,021 A 7/1931 Meyerson
1,970,285 A 8/1934 Douvry
2,089,881 A 8/1937 Dohring
2,099,881 A 11/1937 Emmer
2,112,389 A 3/1938 Trussell
2,139,480 A 12/1938 Young
2,170,147 A * 8/1939 Lane ..... 206/447
2,206,394 A 7/1940 Farkas
2,242,185 A 5/1941 Spinner
2,311,090 A 2/1943 Schade
2,314,204 A 3/1943 Fontecilla
2,322,180 A 6/1943 Vernon
2,328,416 A 8/1943 Blizard et al.
2,363,848 A 11/1944 Emmer
2,367,687 A 1/1945 Phillips
2,374,803 A 5/1945 Broadwell
2,407,656 A * 9/1946 Emmer ..... 281/27.1
2,435,848 A 2/1948 Schade
2,459,541 A 1/1949 Russell
2,466,451 A 4/1949 Liebman
2,489,706 A 11/1949 Emmer
2,502,493 A 4/1950 Trussell
2,571,525 A 10/1951 Blitstein
2,582,953 A 1/1952 Bender
2,629,382 A 2/1953 Gomez
2,664,897 A 1/1954 Derringer
2,779,987 A 2/1957 Jordan
3,180,488 A 4/1965 Heusmann
3,191,319 A 6/1965 Wasigerber
3,205,897 A 9/1965 Jamison
3,224,450 A 12/1965 Whittemore et al.
3,235,925 A * 2/1966 Gerhardt et al. ..... 24/23 EE
3,246,653 A 4/1966 Sexton
3,270,749 A 9/1966 O'Connell
3,276,450 A 10/1966 Pelezzare
3,280,240 A 10/1966 Bardy
3,362,411 A 1/1968 Moller
3,373,748 A 3/1968 Maccormack
3,418,733 A 12/1968 Tyrrell Sr. et al.
3,433,688 A 3/1969 Staats et al.
3,475,775 A 11/1969 Staats
3,483,067 A 12/1969 Staats
3,596,929 A 8/1971 Abildgaard et al.
3,612,709 A 10/1971 Miyamoto
3,654,668 A 4/1972 Appleton
3,706,503 A 12/1972 Foley
RE28,202 E 10/1974 Abildgaard et al.
3,950,107 A 4/1976 Seaborn
3,956,798 A * 5/1976 Wright ..... 281/27.1
3,970,331 A 7/1976 Giulie
4,031,585 A 6/1977 Adams
4,070,736 A 1/1978 Land
4,121,892 A 10/1978 Nes
4,135,832 A 1/1979 Saltz
4,200,404 A 4/1980 Agnew et al.
4,202,642 A 5/1980 Sjostedt
4,202,645 A 5/1980 Giovannetti
4,256,411 A 3/1981 Podosek
4,288,170 A 9/1981 Barber
4,302,123 A 11/1981 Dengler et al.
4,304,499 A 12/1981 Purcocks
4,305,675 A 12/1981 Jacinto
4,369,013 A 1/1983 Abildgaard et al.
4,398,856 A 8/1983 Archer et al.
4,429,901 A 2/1984 Clery, Jr. et al.
4,433,929 A 2/1984 Jones
4,453,850 A 6/1984 Purcocks
4,453,851 A 6/1984 Purcocks
4,511,274 A 4/1985 Chen
4,525,117 A 6/1985 Jones
4,577,985 A 3/1986 Beyer
4,607,970 A 8/1986 Heusinkveld
4,620,724 A 11/1986 Abildgaard et al.
4,645,399 A 2/1987 Scharer
4,674,906 A 6/1987 Abildgaard et al.
4,685,700 A 8/1987 Abildgaard
4,693,624 A 9/1987 Moosmuller
4,708,560 A 11/1987 Abildgaard et al.
4,722,626 A 2/1988 Abildgaard
4,743,048 A 5/1988 Groswith, III
4,832,207 A 5/1989 Alexander
4,832,370 A 5/1989 Jones
4,844,974 A 7/1989 McCullough, Jr. et al.
4,873,858 A 10/1989 Jones
4,900,211 A 2/1990 Vercillo
4,904,103 A 2/1990 Im
4,934,890 A 6/1990 Flatt
4,973,085 A 11/1990 Groswith, III
4,997,208 A 3/1991 Staats, III
5,009,537 A 4/1991 Stengel
5,015,114 A 5/1991 Miller
5,028,159 A 7/1991 Amrich et al.
5,037,229 A 8/1991 Stengel
5,051,050 A 9/1991 Scharer
5,090,859 A 2/1992 Nanos et al.
5,102,167 A 4/1992 Groswith, III
5,123,675 A 6/1992 Staats, III
5,138,855 A 8/1992 Faris
5,162,141 A * 11/1992 Davey et al. ..... 428/76
5,167,463 A 12/1992 Corbishley
5,370,489 A 12/1994 Bagrosky
5,383,756 A 1/1995 Coleman et al.
5,393,156 A 2/1995 Mullin et al.
5,464,312 A 11/1995 Hotkowski et al.
5,524,997 A 6/1996 von Rohrscheidt
5,584,633 A 12/1996 Scharer
5,653,544 A 8/1997 Pijoan et al.
5,669,747 A 9/1997 Scharer
5,782,569 A 7/1998 Mullin et al.
5,895,190 A 4/1999 Viola
6,168,337 B1 * 1/2001 Adams ..... 402/8
6,270,280 B1 8/2001 Baumann
6,394,684 B2 5/2002 Kapur et al.
6,435,753 B1 8/2002 Gusack
6,450,492 B1 9/2002 Coombs et al.
6,655,868 B2 12/2003 Drew
6,669,392 B2 12/2003 Rebora
6,955,493 B2 10/2005 Acquaviva et al.
6,976,719 B2 * 12/2005 Agayof et al. ..... 294/150
7,198,422 B2 4/2007 Ng et al.
2003/0147687 A1 8/2003 Freund et al.
2004/0052615 A1 3/2004 Fuchs et al.
2004/0240967 A1 12/2004 Crudo et al.

FOREIGN PATENT DOCUMENTS

CH 692912 12/2002
DE 1094708 12/1960
DE 1200252 9/1965
DE 8622425 10/1986
DE 29808713 9/1998
EP 0390199 10/1990
EP 0527246 2/1993
EP 0704322 4/1996
EP 0842790 5/1998
EP 1124694 1/2003
FI 31504 12/1960
FR 1060284 3/1954
FR 1228267 8/1960

| | | |
|---|---|---|
| FR | 1364099 | 5/1964 |
| GB | 229515 | 2/1925 |
| GB | 755953 | 8/1956 |
| GB | 1225120 | 3/1971 |
| GB | 1372055 | 10/1974 |
| GB | 1569497 | 6/1980 |
| GB | 2193466 | 2/1988 |
| JP | S3610616 | 5/1961 |
| JP | H08175058 | 7/1996 |
| JP | H08176421 | 7/1996 |
| JP | H08290692 | 11/1996 |
| JP | 9240184 | 9/1997 |
| JP | 2000247078 | 9/2000 |
| JP | 200417290 | 1/2004 |
| WO | 0024592 | 5/2000 |
| WO | 200024592 | 5/2000 |
| WO | WO 00/40426 | 7/2000 |
| WO | WO 00/58112 | 10/2000 |
| WO | WO 01/49569 | 7/2001 |

* cited by examiner

BINDING ELEMENTS AND PLURALITY OF BINDING ELEMENTS PARTICULARLY SUITED FOR AUTOMATED PROCESSES

RELATED APPLICATIONS

This application is a continuation-in-part of International Application Serial No. PCT/US2005/024620 filed Jul. 12, 2005, which claims priority to U.S. Provisional Patent Application Ser. No. 60/587,224 filed Jul. 12, 2004 and to U.S. Provisional Patent Application Ser. No. 60/643,009 filed Jan. 11, 2005, all of which are incorporated herein by reference.

FIELD OF THE INVENTION

The present invention relates to binding elements for holding a plurality of perforated sheets or the like, and more specifically the invention pertains to structure for coupling binding elements particularly useful in automated binding processes.

BACKGROUND OF THE INVENTION

Typically, mechanically bound books are created using either relatively small, inexpensive machines that require a significant amount of labor to create each book, or large, expensive machines that require much less labor per book. Use of small, inexpensive machines is widespread inasmuch as they are present in many offices. Such machines are adequate for creating relatively small quantities of books. As the number of books to be assembled increases, however, the manpower required is significant when utilizing such small, inexpensive machines. In practice, it is not uncommon for operators to spend an hour or more assembling twenty to fifty books.

Automated machines, on the other hand, are relatively uncommon in offices. Rather, they are most often found in dedicated print shops or binderies. While these machines may be capable of creating the twenty to fifty books in as little as two to five minutes, the size and cost of automated machines can be prohibitive to smaller or occasional users. Further, it is often time consuming for operators to set up such automated machines or to modify machines to change from one size or color of binding element to another. The specialized training required to operate and set-up automated binding machines further limits benefits available to general office users.

Various types of binding elements have been utilized to mechanically bind a stack of perforated sheets or the like, including metal spiral wire or plastic spiral, double loop wire, wire comb, or hanger-type designs, plastic comb, hot-knife or cold-knife strip (e.g., VeloBind® available from General Binding Corporation), and loose leaf binders (e.g., 3-ring binders).

Such binding elements are not generally adaptable to highly automated binding machines. Automated binding machines require a supply of binding elements be located in or proximal to the device. The greater number of binding elements that can be loaded into a binding element magazine, the longer the machine can run without operator intervention. While an element magazine of fifty to one hundred binding elements would seem ideal for general office use, the bulky nature of most currently available binding elements would generally make magazines required to accommodate such a large number of binding elements impractical. Loose-leaf binders, for example, are poor from this standpoint inasmuch as the integral covers and ring assemblies take up considerable space.

When previously-formed binding elements are utilized, not only must the element magazine contain a sufficient quantity of binding elements to minimize operator loading, it must support, align and present the binding elements in a form suitable for interaction with the binding machine. Thus, the binding elements must be presented such that the binding machine may remove an element from the magazine and position it in the binding mechanism for interaction with a stack of sheets and before finally finishing the book. The structure of virtually all loose binding elements makes them highly prone to tangling unless the elements are controlled by the magazine. As a result, if the packaging method does not control the elements, the binding machine must have sufficient mechanism to disentangle the elements. Such detangling mechanisms would presumably be prohibitively complex, as well as expensive and unreliable.

Thus, each of the binding elements currently known and available in the industry presents certain disadvantages, either in the packaging of the elements prior to binding, the automation of the binding process in connection with the elements, or in the qualities of a book bound by the elements.

SUMMARY OF THE INVENTION

Accordingly, it is desirable to create binding elements and moderately priced, user-friendly, reliable mechanical binding machines that will be available other than exclusively to large volume binderies.

The invention provides a plurality of binding elements that are particularly suitable for usage in automated binding processes. The individual binding elements comprise a spine from which a plurality of fingers extend. The binding element lies flat and is preferably of a substantially uniform thickness such that it may be stamped from a sheet of material. The binding element includes an inner or rear surface and an outer or front surface. After being assembled into a stack of sheets, the fingers are looped over and coupled to the spine such that the inner or rear surface of the fingers is disposed against the inner or rear surface of the spine. While the fingers may be attached by any appropriate means, preferably a pressure activated adhesive portion is provided along the spine. In accordance with teachings of the invention, at least a portion of the outer surface of the binding element is resistant to a more permanent attachment to the adhesive. As a result, a plurality of the binding elements may be stacked together, and successively decoupled or removed for insertion into a stack of sheets. The resistance to a more permanent adhesion may be provided by any appropriate means, such as, for example, a release coating such as silicone.

The binding elements may be provided with score lines or bends along the fingers in order to provide a rounded closed loop structure. Gussets may be provided along the bends in order to inhibit straightening of the fingers. Further, the fingers preferably include variations in their cross-section along the length of the fingers such that the variations relieve certain stresses to inhibit the finger from bending at stress concentration locations.

The plurality binding elements further preferably provide structure for facilitating interaction with an automating binding process. For example, the binding elements may include structure such as openings, recesses, or notches for facilitating placement within a binding machine or the like, structure such as recesses or protrusions for facilitating separation of adjacent binding elements, and structure for facilitating the automated closure of the fingers, such as recesses or protrusions.

Other features and aspects of the invention will become apparent by consideration of the following detailed description and accompanying drawings.

BRIEF DESCRIPTION OF THE DRAWINGS

FIG. 35*b* is a front perspective view of the binding element of FIG. 26, illustrating one of the fingers of the binding element being fastened to the spine of the binding element.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

DETAILED DESCRIPTION

Figure 1:
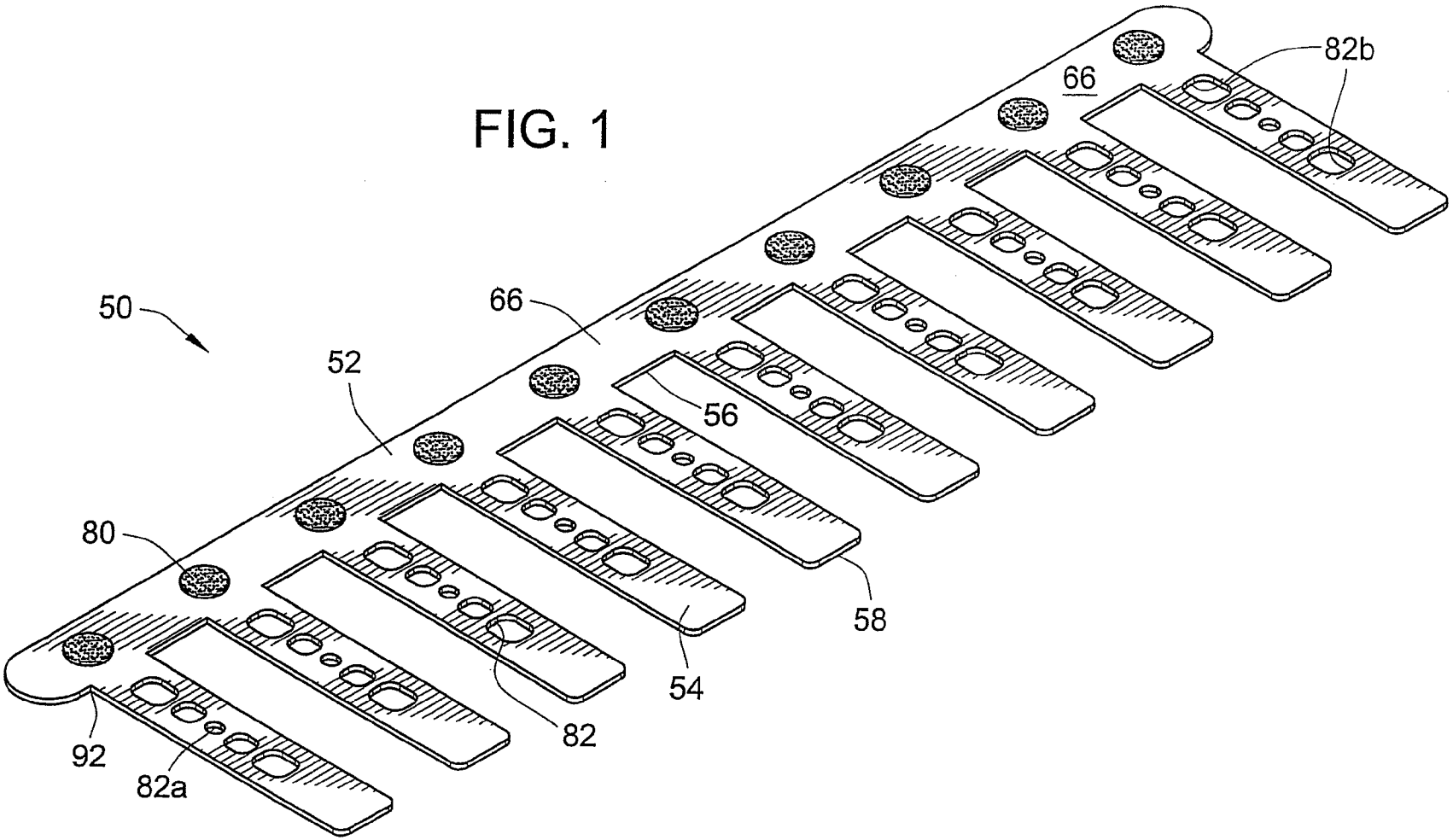
FIG. 1 is a perspective view of an exemplary embodiment of a binding element constructed according to teachings of the invention.
Figure 2:
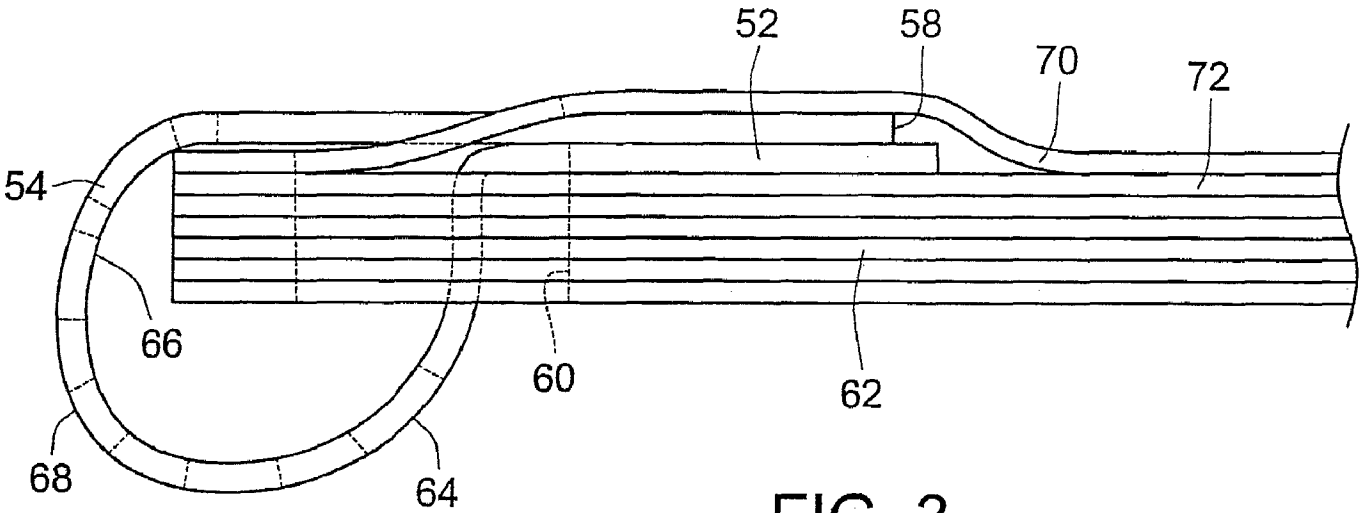
FIG. 2 is a fragmentary side elevational view of the binding element of FIG. 1 in a binding position in a stack of sheets.

Turning now to the drawings, there is shown in FIG. 1, a binding element 50 constructed in accordance with teachings of the invention. The binding element 50 includes a spine 52 from which a plurality of fingers 54 extend along one edge 56. As shown in FIG. 2, in assembly into a stack of perforated sheets 62, the distal ends 58 of the fingers 52 are inserted into the perforations 60, and the distal ends 58 of the fingers 54 are coupled to the spine 52 to form a closed loop 64 through the stack of sheets 62. The binding element 50 includes an inner face 66 and an outer face 68. Significantly, in a currently preferred assembly of the binding element 50, the inner face 66 of the distal ends 58 of the fingers 54 are disposed against the inner face 66 of the spine 52, as shown in FIG. 2. Consequently, the looped portion 64 for each finger 54 of the binding element 50 extends outward from one edge 56 of the spine 52. As a result, the spine 52, with the distal ends 58 of the fingers 54 attached thereto, may be disposed between two of the sheets of the stack 62. Preferably, the spine 52 with the attached distal ends 58 is disposed between the back cover 70 and the final sheet 72 of the bound stack 62, as shown in FIG. 2. In this way, the bound stack of sheets 62 and the closed binding element 50 provide an appealing presentation of a bound book. Moreover, because the edge of the bound book presents only a plurality of parallel fingers 54, rather than a spine, the individual sheets of the book may be laid flat on a surface, or the consecutive sheets turned and disposed entirely against the back cover 70 as the consecutive sheets of the bound book are being viewed.

The distal ends 58 of the fingers 54 may be secured to the spine 52 by any appropriate means. In a currently preferred embodiment, an adhesive 80 is provided along at least a portion of the inner face 66 of the spine 52, as shown, for example, in FIG. 1. The adhesive 80 may be any appropriate adhesive that will provide adequate securement between the fingers 54 and spine 52. An acrylic based pressure sensitive adhesive, specifically 3M 220 Stamark™ is currently a preferred adhesive, although any appropriate bonding adhesive [s] may be utilized, such as, for example, two-part adhesives, super PSA or PSA with release paper, water activated adhesives, hot melt adhesives, or ultraviolet curing adhesives. It will be appreciated that other coupling means may be additionally or alternately provided. By way of example, only, the distal ends of the fingers may be mechanically coupled to the spine by methods similar to those disclosed in U.S. application Ser. No. 10/488,193, which is assigned to the assignee of this application and is incorporated herein by reference for all that it discloses. Alternately, for example, heat, welding, spin welding, flap locks, zip locks, integral snaps or rivets, lock tabs, Velcro®, stapling, staple-free stapling, rivets, rolling, or staking may be utilized.

Figure 3:
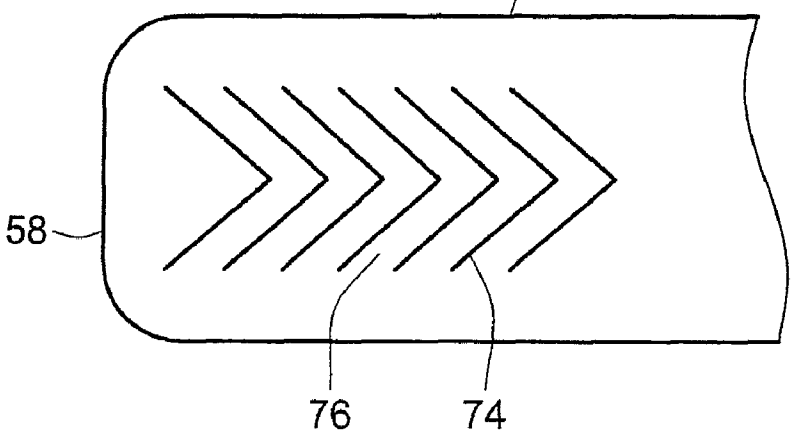
FIG. 3 is an enlarged fragmentary plan view of the tip of a finger element of a binding element constructed in accordance with teachings of the invention.

The securement may be of a removable nature so that pages may be removed or added. Alternately, in order to provide a tamper-resistant binding, the securement may be of a more permanent nature, and/or the arrangement may be provided with a tamper-evident structure. For example, as shown in FIG. 3, the distal tip 58 of the fingers 54 may be provided with weakened portion, such as may be provided, for example, by a series of cuts 74 or a thinned area. It will be appreciated by those of skill in the art that when such cuts 74 or a thinned area at the distal end 58 of the finger 54 are positioned over a more permanent adhesive securement 80, the holding force of the securement will be greater than the strength of the thin pieces 76 of the binding element material formed between the cuts 74 or a thinned area. As a result, the thin pieces 76 or a thinned area will likely deform or break as one attempts to pry the distal end 58 of the finger 54 from the spine 52, providing evidence of tampering. Notably, the cuts 74 are V-shaped, and directed such that they will not interfere with the advancement of the distal ends 58 of the fingers 54 as they are directed through the perforations 60 in the stack of sheets 62.

According to an important feature of the invention, the closed loop 64 of the fingers 54 present a relatively smooth and uniformly arched finger 54 profile. It will be appreciated by those of skill in the art that such relatively thin, flexible finger elements as may be flexed and looped toward the spine 52, will generally provide a concentration of forces at a given location along the length of the looped length of the finger 54. This bending can result not only in an unappealing appearance to the binding element and bound book, but it can result in difficulty in turning of the successive sheets of a bound stack, particularly if concentrated bending results along the length of any of the fingers 54.

In order to provide a relatively uniform, rounded closed loop to the fingers 54, the fingers 54 are provided with a varied cross section along the length thereof such that the bending stresses are more uniformly distributed along the length of the looped finger 54. This varied cross section may be accomplished by various structural arrangements. For example, as shown in FIG. 1, the fingers may be provided with reliefs or cutouts 82 of varied sizes. It will be appreciated by those of skill in the art that a larger cross section is desirable along that portion of the strip wherein the greatest bending stresses would be concentrated and a smaller cross section would be desirable along those portions where lesser stresses would be distributed in a looped finger 54. Accordingly, the invention provides a smaller cutout 82*a* along the generally central portion of the binding element and a relatively larger cutout 82*b* along the portion(s) of finger 54 more proximal to the spine 52 and toward the distal end 58 of the fingers 54. In this way, as shown in FIG. 2, the looped finger 54 provides a smooth transition throughout its looped length.

Figure 6:
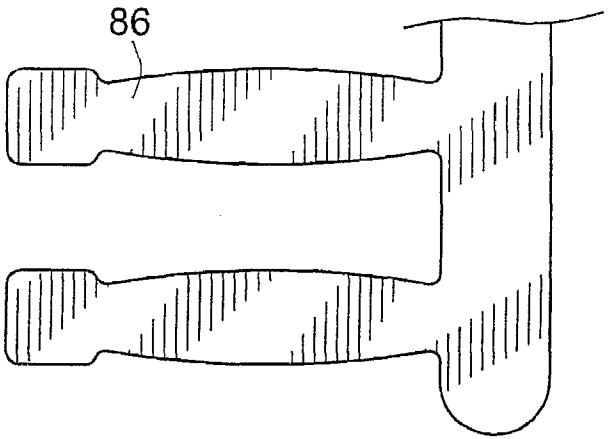
FIG. 6 is a fragmentary plan view of an exemplary finger element construction of another alternate embodiment of binding elements constructed in accordance with teachings of the invention.
Figure 7:
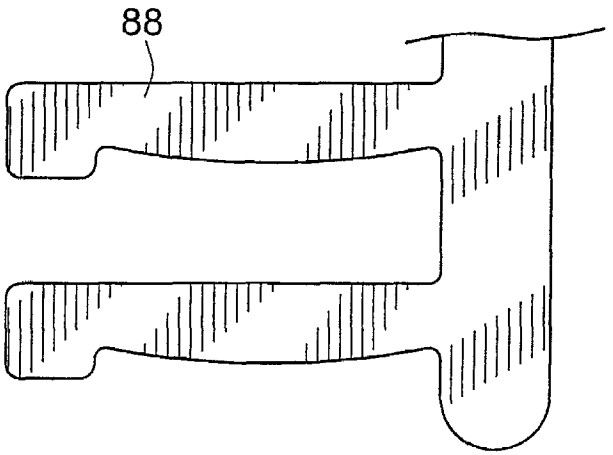
FIG. 7 is a fragmentary plan view of an exemplary finger element construction of another alternate embodiment of binding elements constructed in accordance with teachings of the invention.
Figure 4:
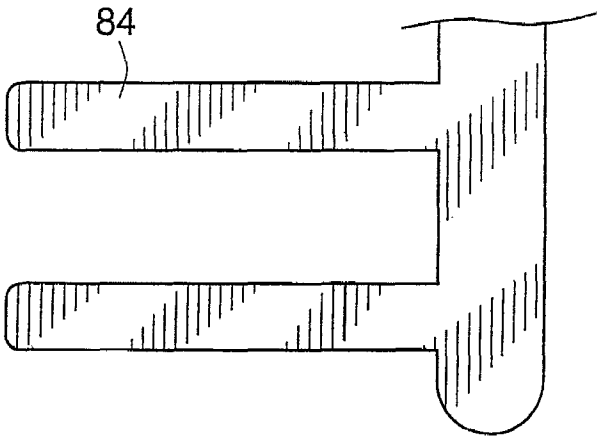
FIG. 4 is a fragmentary plan view of an exemplary finger element construction of an alternate embodiment of binding elements constructed in accordance with teachings of the invention.
Figure 5:
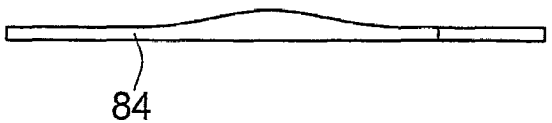
FIG. 5 is a side elevational view of the binding element of FIG. 4.

It will be appreciated by those of skill in the art that, in accordance with the invention, alternate varied cross sectional arrangements will likewise provide the desired variation in the bending stresses along the length of a flexible binding element finger. For example, a single cutout 83 may be provided, such as the teardrop shape shown in FIG. 16. As shown in FIG. 4, the fingers 84 may have a uniform width, and a varied thickness, as shown in FIG. 5. Alternately, rather than including reliefs or cutouts, the fingers 86, 88 may comprise a varied outer profile, as shown, for example, in FIGS. 6 and 7, respectively, or a series of segments may be cut in the outer surface or perimeter of the fingers. Thus, such stress relief may be provided, for example, by way of structural variations such as cut patterns, width or thickness changes, or segmenting, or any combination of these.

Figure 9:
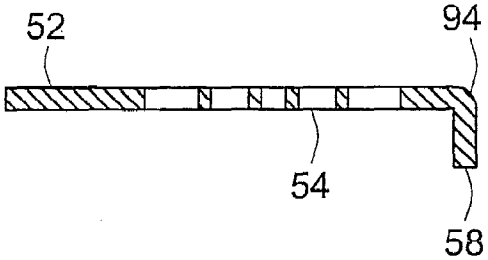
FIGS. 8 and 9 are cross-sectional views of the binding element of FIG. 1 showing exemplary bends in the binding element.
Figure 11:
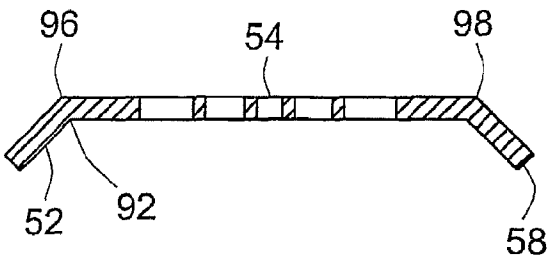
FIG. 11 is a cross-sectional view of the binding element of FIG. 1 showing alternate exemplary bends in the binding element.
Figure 8:
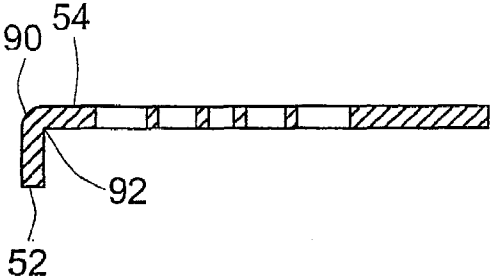
Figure 10:
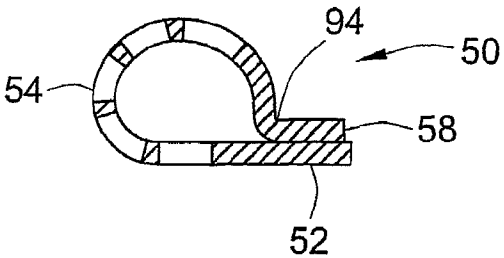
FIG. 10 is a cross-sectional view of the binding element of FIG. 9 in a closed position.
Figure 12:
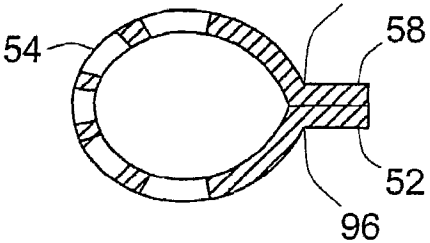
FIG. 12 is a cross-sectional view of the binding element of FIG. 11 in a closed position.

In order to further provide more appealing annular closed finger loops 64, a plurality of bends may be provided in the binding element 50 to facilitate the formation of a generally circular finger loop profile. For example, as shown in FIG. 8, a plurality of bends 90 may be provided at the proximal ends 92 of the fingers 54, such as substantially at the point where the fingers 54 meet the spine 52, to provide the general profile as illustrated in FIG. 2. Alternately, as shown in FIG. 9, the fingers 54 may include a plurality of bends 94 spaced from their distal ends 58 such that the closed binding element 50 will have a general profile as illustrated in FIG. 10. It will be appreciated that the binding element 50 may include any number of alternate bending arrangements, such as, for example, a combination of bends 96, 98 at the proximal ends 92 and at the distal ends 58 of the fingers 54, as shown in FIG. 11, yielding the general profile as illustrated in FIG. 12. Such bends may be provided in the binding element as provided to the user, or the binding element may include appropriate score lines that encourage such bending. Alternately, such bends may be made at the binding machine itself. The bends may be provided by any appropriate method. For example, they may be fabricated or facilitated during an extruding or molding process, or they may be provided as a result of a subsequent process, such as a scoring or pounding of the binding element. It will be appreciated, for example, that score lines placed at the location of the bends may be used to facilitate bending by creating a greater freedom of movement at the bend location.

Conversely, bends 90, 94, 96, 98 that are induced as a result of pounding a substantially flat element, for example, result in an alteration of the structure such that, over time, bends 90, 94, 96, 98 may have a tendency to relax from their desired form (see FIGS. 8-12). This may likewise be a problem in binding elements wherein the bends 90, 94, 96, 98 are formed in the binding element during an extruding or molding process. This relaxation may be due to factors such as heat, the type of material used, etc. In some embodiments, this relaxation may be undesirable.

In order to minimize the effect of relaxation in the final binding element, such relaxation may be taken into account in the initial fabrication of the binding element. For example, the binding elements may be fabricated with bends 90, 94, 96, 98 at an angle greater than the desired angle. Thus, over time the angle will eventually relax to the approximate desired angle. By way of example only, and not limitation, if the desired angled of the bend is approximately 90°, then creating an initial bend at approximately 110° would allow the bend to eventually relax at or near the desired angle as opposed to an angle much lower than desired. By way of comparison, if the angle were initially set at approximately the desired angle, then any relaxation could result in a bend angle below the desired angle within a relatively short timeframe. A greater than desired initial bend angle could be applied to any bend on the binding element. Furthermore, a greater than desired initial bend angle could be applied to the binding element either before or after insertion into the binding machine or stack of sheets to bound.

Figure 23:
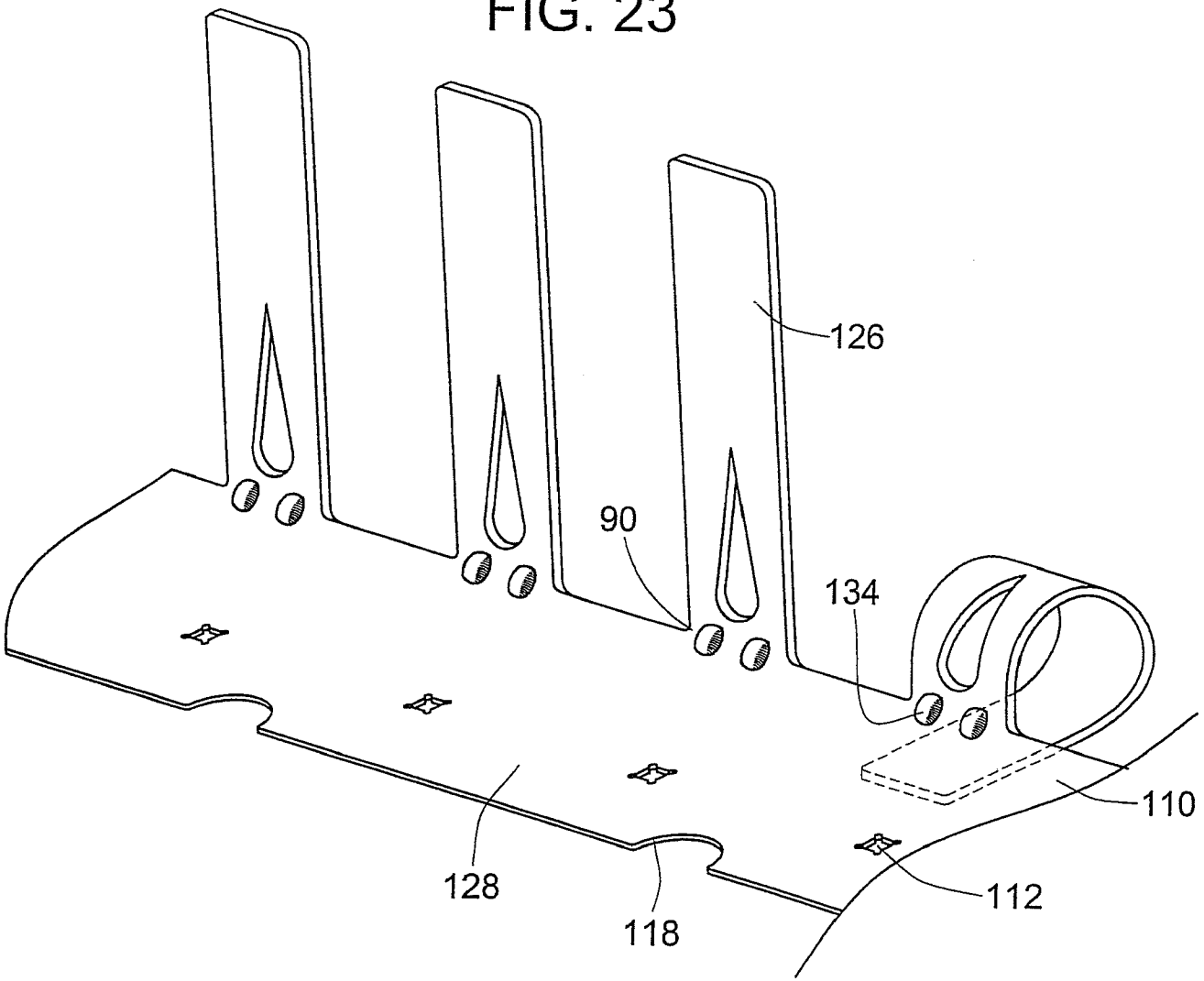
FIG. 23 is a perspective view of an alternate embodiment of a binding element constructed in accordance with teachings of the invention.
Figure 25:
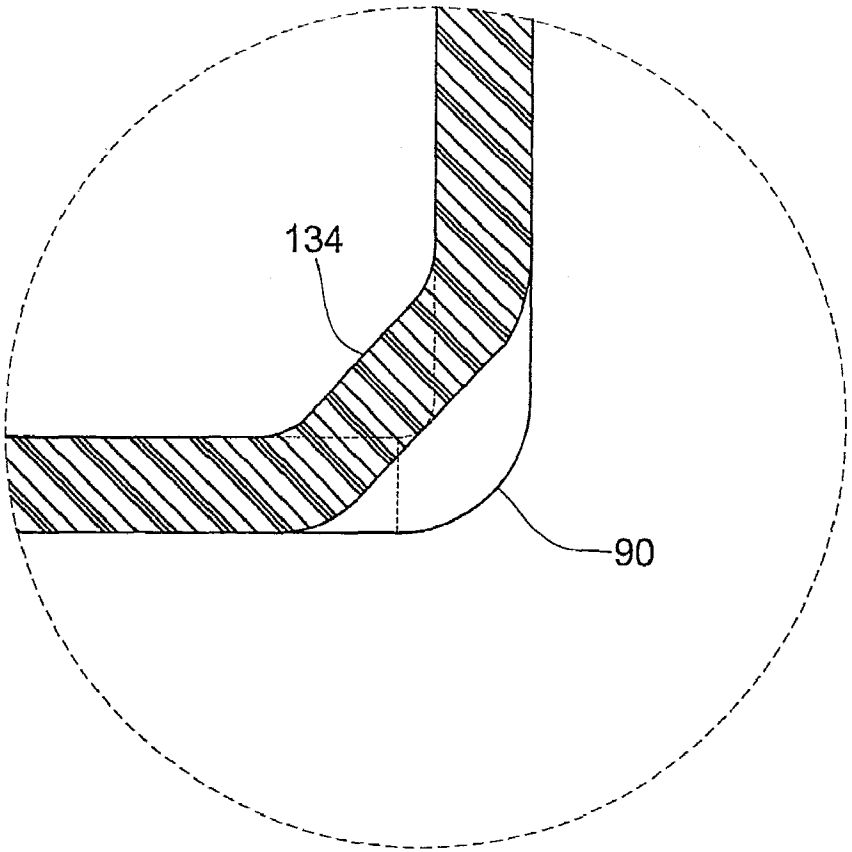
FIG. 25 is an enlarged, fragmentary cross-sectional view of the binding element of FIGS. 23 and 24.
Figure 24:
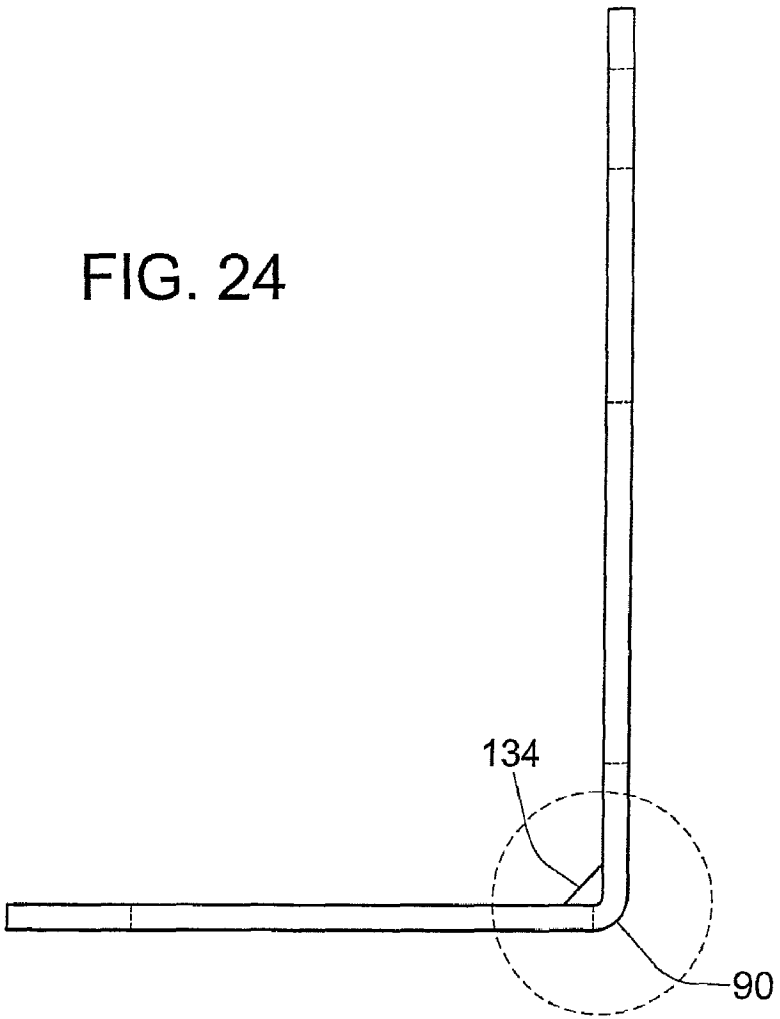
FIG. 24 is a side elevational view of the binding element of FIG. 23.

In accordance with an alternate embodiment of the invention, the binding element may be provided with additional structure that facilitates resistance to the relaxation of bends. As shown in FIGS. 23-25, for example, a gusset 134, or other similar bend reinforcement, may be created at the bend 90 to strengthen the bend and inhibit relaxation of the bend angle. While FIG. 23 shows the use of two gussets 134 at bend 90 to strengthen the bend and maintain the desired bend angle, it will be appreciated by those of skill in the art that the number of gussets 134 used may be one or more. Similarly, the location of the gusset 134 along the axis of the bend may be adjusted depending on design preference, finger 126 width, and the number of gussets 134 used. Moreover, the use of gussets 134 is not limited to bend 90 but is equally applicable to other bends in the binding element 110, such as bends 94, 96, 98 (see FIGS. 9-12) or any other bend on the binding element. The gusset 134 may be created by any appropriate method and may take place prior to or after insertion into the binding machine. It is further noted that a gusset 134 and a greater than desired initial bend angle could be utilized in combination to restrict relaxation to approximately the desired bend angle.

Figure 13:
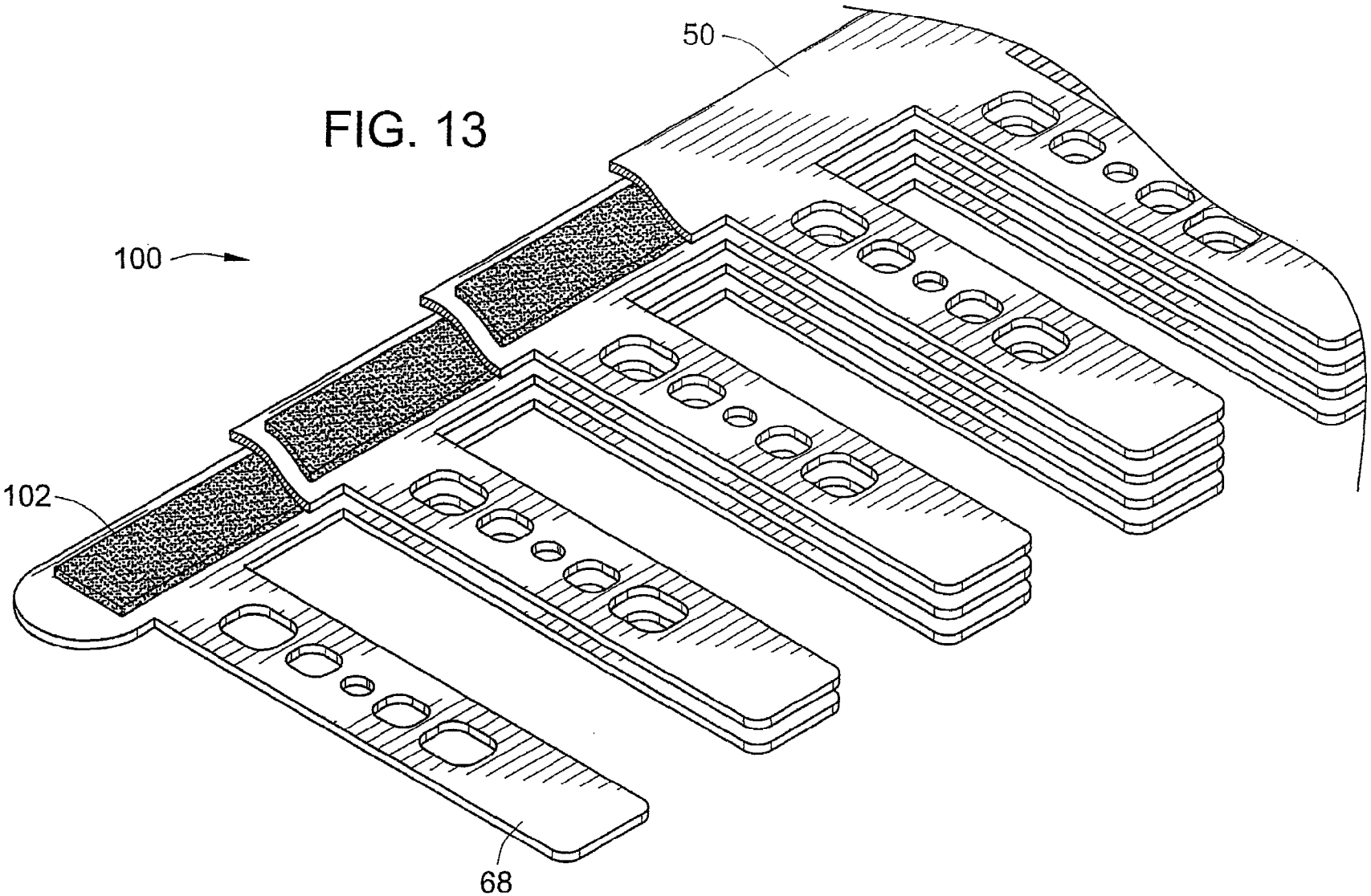
FIG. 13 is a perspective view of a plurality of binding elements similar to those of FIG. 1 constructed in accordance with teachings of the invention.
Figure 21:
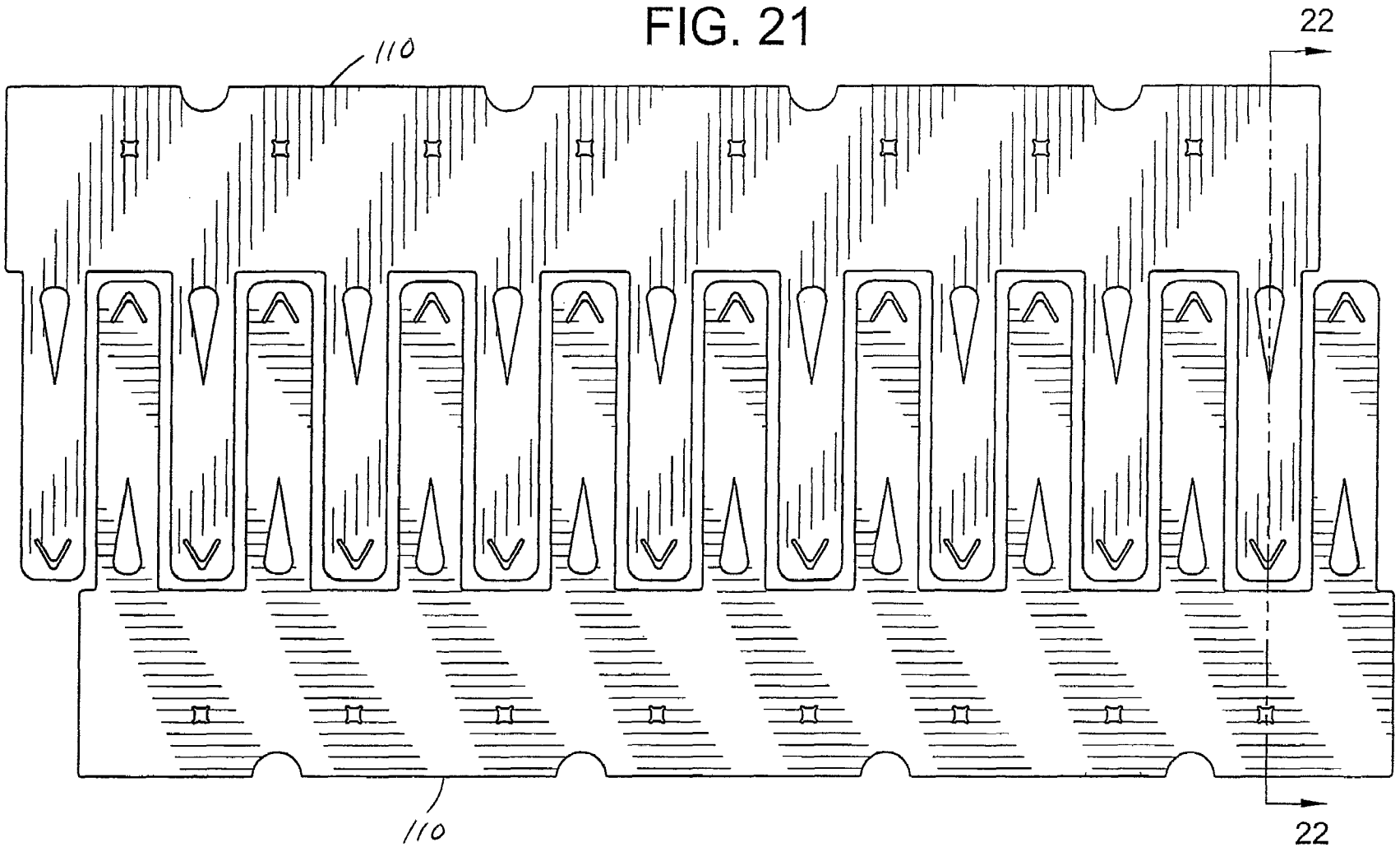
FIG. 21 is a plan view of two stacks of a plurality of binding elements of FIG. 14 in an nested arrangement according to teachings of the invention.

In accordance with another important feature of the invention, a plurality binding elements 50 may be provided as a single unit 100, as shown, for example in FIG. 13. While FIG. 13 shows the stacked binding elements 50 partially broken away for explanation purposes, it will be appreciated by those of skill in the art that the single unit 100 of a plurality of binding elements 50 may be handled as a single unit without the need for a cartridge or the like. As a result, the single unit 100 may be readily placed in an automated binding machine, greatly simplifying the automated binding process. Preferably, the binding elements have a relatively thin, uniform thickness, such as is illustrated. In this way, a relatively large number of binding elements presents a very compact unit that may be readily packaged for shipment or storage, as well as retained in a magazine area of a binding machine for use in an automated binding process. Additionally, the illustrated structure presents further packaging advantages in that two such stacks of binding elements may be readily disposed in a single package with the stack of fingers from the binding elements of the respective stacks alternatingly disposed in a single plane, the stacks of spines of the binding elements of the respective stacks being disposed outboard the adjacently disposed fingers (see, e.g., FIG. 21). As a result, very little space is lost in the packaging of such binding elements.

Figure 14:
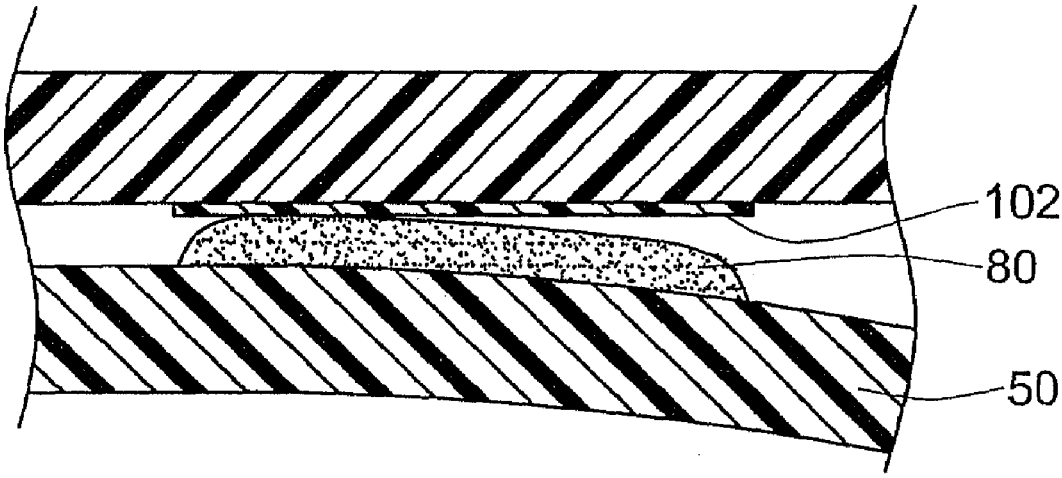
FIG. 14 is an enlarged fragmentary cross-sectional view of two adjacently disposed binding elements constructed in accordance with teachings of the invention.

In order to facilitate this efficient stacking of the binding elements 50, at least a portion 102 of the outer face 68 of the binding elements 50 is provided with a surface that is resistant to the adhesive 80, as shown, for example in FIG. 13. The portion 102 resists permanent coupling with the adhesive 80, yet allows the binding elements 50 to be adjacently disposed for storage or delivery to an automated binding machine. During the stacking process, this portion 102 is disposed adjacent the adhesive 80 of the adjacent binding element, as shown in FIG. 14. In this way, the binding elements 50 may be temporarily coupled together in the stacked unit 100, yet easily separated for insertion into a stack of sheets in the binding process. It will be appreciated that the adjacent stacking of the binding elements 50 eliminates the need for a backing strip adjacent the adhesive 80, as well as the waste accompanying the same.

The portion that is resistant may be only a limited portion, e.g., only the portion that is disposed directly adjacent the adhesive of the adjacent binding element when the binding elements are stacked as a group, an elongated strip 102 of the binding element (as shown in FIG. 13), or the entire outer face 68 of the binding element 50 may be resistant to the adhesive. For the purposes of this further explanation, the term "portion 102" will be utilized, but it will be understood that the term "portion 102" may thus include an entire side of the binding element, a relatively small portion of a side of a binding element, or any extent along the continuum. The provision of the entire outer face being resistant to the adhesive yields a more simplified fabrication process in that one entire side of a sheet of stock from which the binding elements are cut may be rendered unresponsive to permanent bonding with the adhesive. The portion 102 may be provided by any appropriate means that renders the surface of the material of the binding element 50 resistant to relatively permanent bonding with the particular adhesive utilized. By way of example only, the portion 102 may include a silicone or Teflon® coating, or the like. Alternately, the material from which the binding element is fabricated may include properties that allow a more permanent bond along the inner surface 66, yet a less permanent bond on the opposite outer surface 68, or surface treatments on either surface. The adhesive or release coat may be directly bonded to the material of the strip, or surface preparation may be utilized to promote the application of one and/or the other, including procedures such as abrading, corona treating, flame treating, etching, and applying an enhancing coat, such as a primer.

Figure 15:
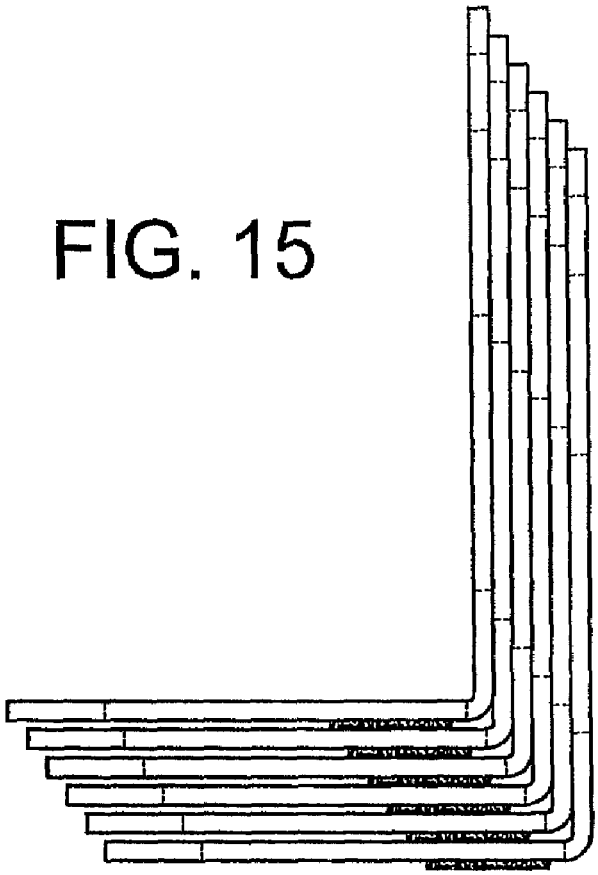
FIG. 15 is a side elevational view of a plurality of binding elements constructed in accordance with teachings of the invention.

It will be appreciated that this same stacked, coupled arrangement may be provided, even if the binding elements 50 are provided with bends, as shown, for example, in FIG. 15. Just as the portion 102 may be attached to the surface of the material of the binding element 50 resistant to the relatively permanent bonding with the particular adhesive utilized, so too may a release coating be attached to the interior of the packaging in which the binding elements 50 are contained prior to usage. A release coating on the packaging interior prevents the binding element from undesirable attachment to the packaging and eliminates the need for a backing strip on the exposed adhesive of an outer binding element to avoid such attachment. It will be appreciated that the use of a release coating on the package interior saves time during binding loading because the loader need not remove a backing strip, prevents the possibility of loading error due to an operator neglecting to remove the backing strip, and eliminates the waste associated with such a backing strip.

In order to facilitate an automated binding process, the binding elements preferably include additional features specifically designed to accommodate mechanical interface with an automated binding machine. One such feature is locating structure for placement of the binding elements in an automated binding machine. In the embodiment illustrated in FIG. 16, the binding elements 110 are provided with at least one engagement opening 112, here, a series of engagement openings 112 that extend, for example, along the length of the binding elements 110. A currently preferred form of the engagement openings 112 includes a generally square structure 113 with plurality of slots 114 extending from the corners of the square structure 113 (see FIG. 17). In this way, one or more pins may be received in the stacked unit 116 of binding elements 110 to properly locate the same within the automated machine. While the locating structure has been illustrated with regard openings with in the individual binding elements 110, it will be appreciated by those of skill in the art that the locating structure may alternately be alternately disposed, for example, as recesses or protrusions or the like in the outer perimeter of the binding elements. For example, if a stack of elements 110 identical to those illustrated in FIG. 16 were provided, the aligned recesses 118 could be utilized in the placement of the binding element 110 stack in a binding machine. In this way, the binding may include locators that will consistently locate a stack of binding elements, regardless of the particular size of binding element utilized.

Figure 17:
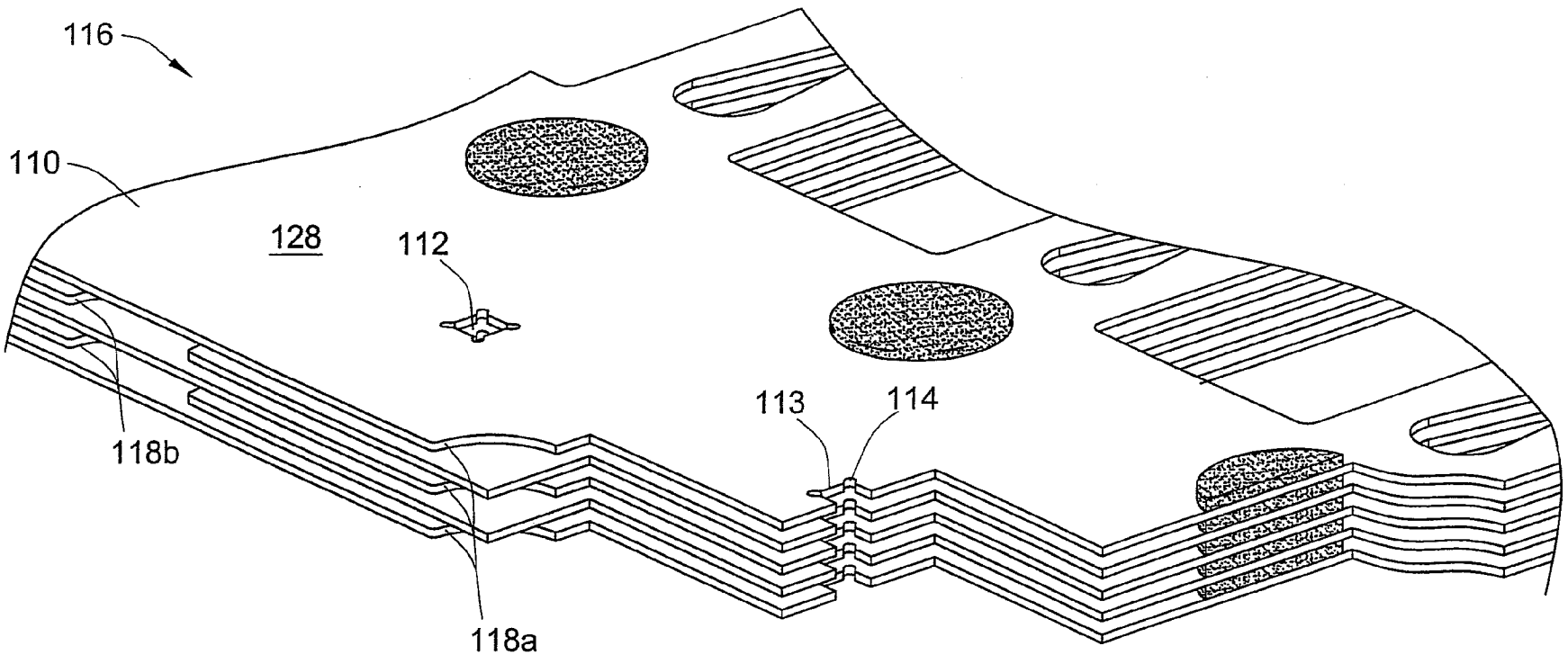
FIG. 17 is a fragmented, perspective view of a plurality of binding elements of FIG. 16 partially cut away.
Figure 18:
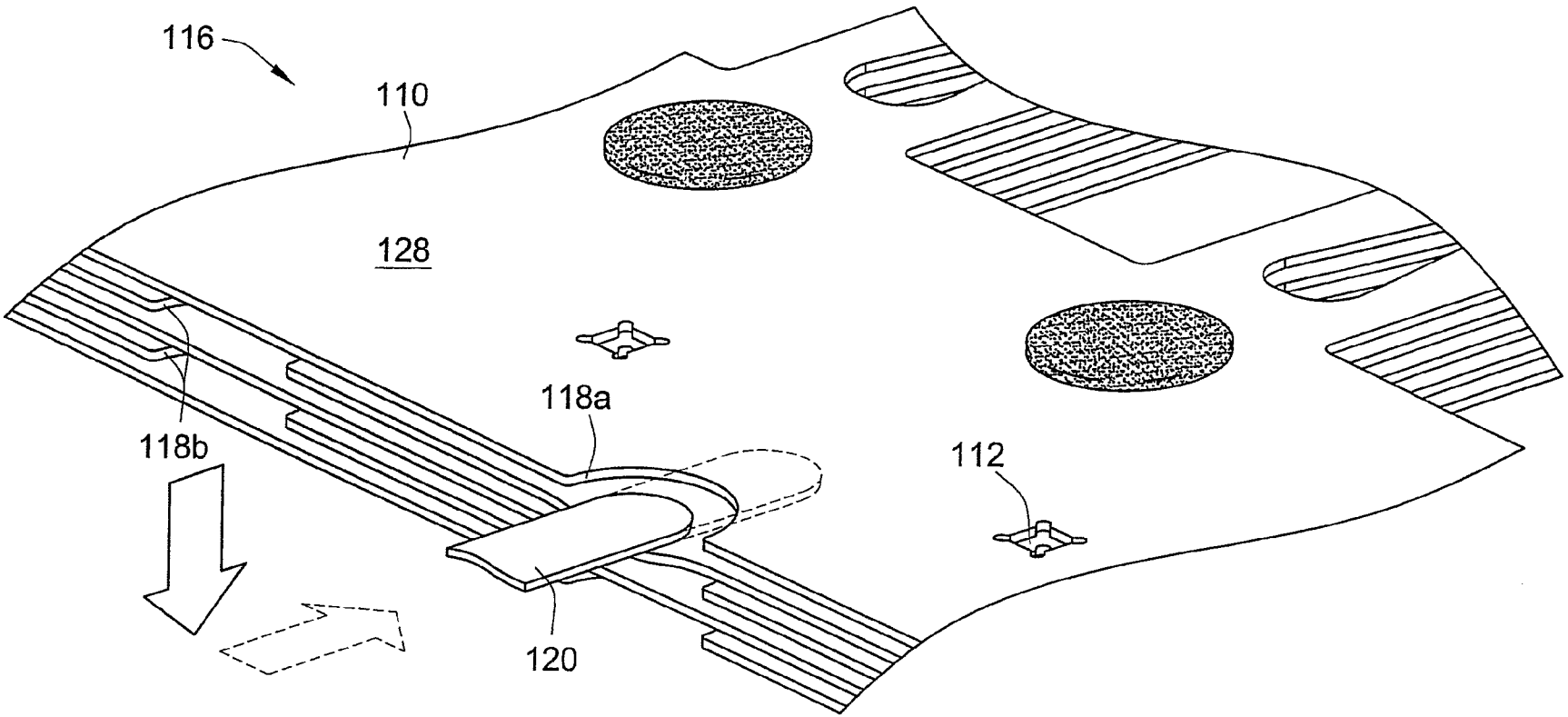
FIG. 18 is an enlarged, fragmentary perspective view of a plurality of the binding elements of FIG. 17 as engaged by a component of an automated binding machine.

The binding element may further include structure that facilitates the separation of the adjacent binding elements 110 during the automated binding process. For example, the binding elements 110 may include protrusions or the recesses 118*a*, 118*b* in the outer perimeter of the binding element 110 (FIGS. 17-18) may be staggered. Thus, during the binding process, a probe 120 from the binding machine may be inserted at one or more of the recesses 118*a* of the upper or lower most binding element 110, as shown in FIG. 18. The probe 120 may be moved slightly upward or downward in the stack 116 during this process to facilitate this separation to the extent that the binding elements 110 themselves are pliant. The probe 120 may then be used to separate the adjacent binding elements 110 to the extent required by the automated binding machine.

It will be appreciated by those of skill in the art, however, that alternate mechanisms may be utilized to facilitate separation of adjacent binding elements during a binding process. For example, adjacent binding elements as illustrated in FIG. 13, 15, 17 or 18 may be separated by a suctioning device or the like that exerts sufficient force against the binding element 110 to create separation of the adhesive 80 from the portion 102 of the adjacent binding element.

Figure 16:
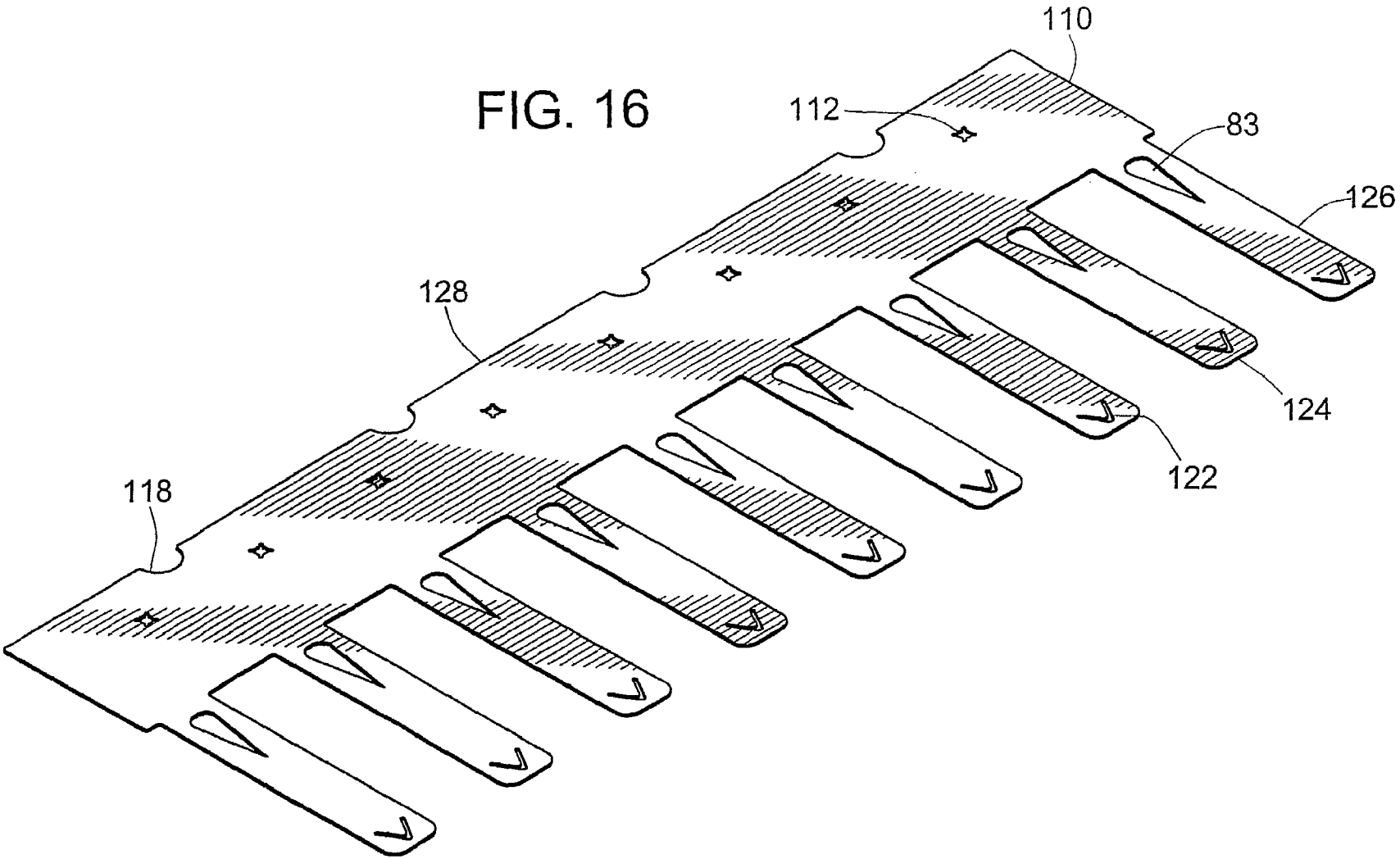
FIG. 16 is a perspective view of an alternate embodiment of a binding element constructed in accordance with teachings of the invention.
Figure 19:
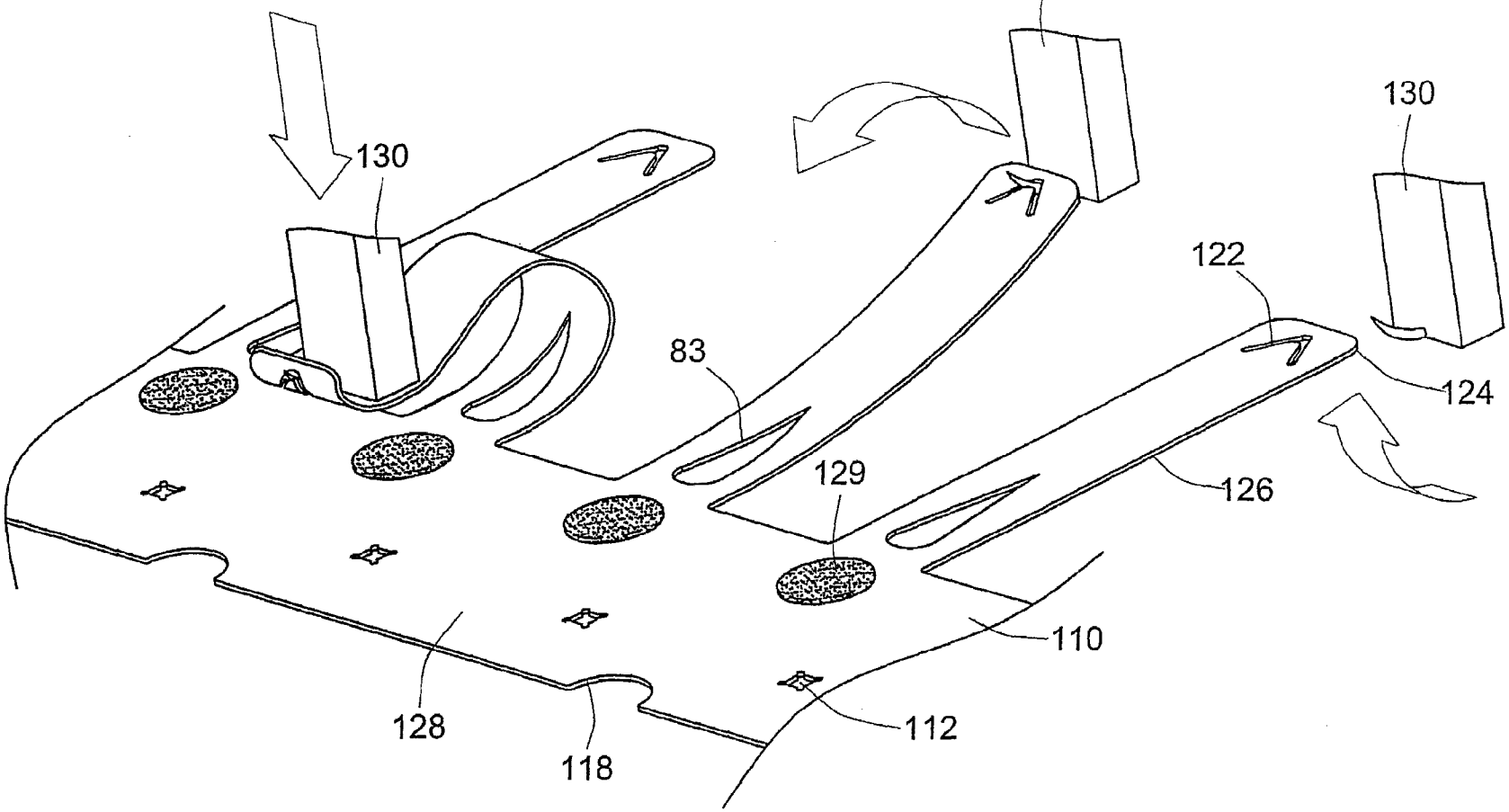
FIG. 19 is a perspective view of the binding element of FIG. 16 during an exemplary assembly process accordingly to teachings of the of the invention.
Figure 20:
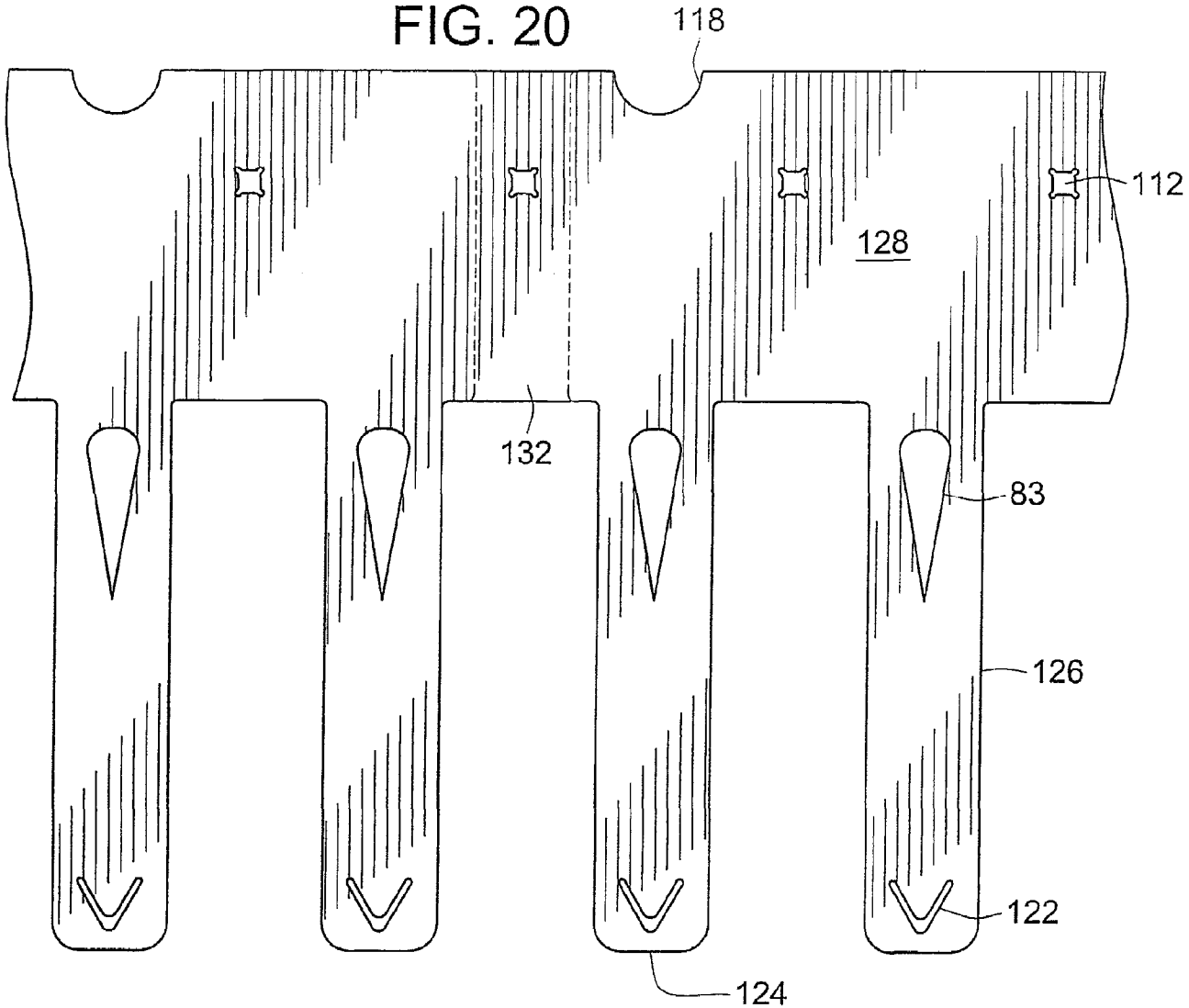
FIG. 20 is a plan view of adjacent ends of a pair of binding elements of FIG. 14 according to one method of construction in accordance with teachings of the invention.

Further, the binding elements 110 may be provided with engaging structure that facilitates an automated process for physically closing the fingers of the binding elements 110. As shown in FIGS. 16 and 19, for example, an opening 122 may be provided in the distal end 124 of the binding element fingers 126. In assembly, a finger closing mechanism 130 may be provided that engages the opening 122 to lift the distal end 124 of the finger 126 and move it toward the spine 128 as progressively shown in FIG. 19. The closing mechanism 130 preferably then would then exert a closing force on the distal end 124 of the finger 126 to activate the adhesive 129 at the spine. While the form of the engaging structure 122 is illustrated as a "V-shape," it will be appreciated that an alternate structure may be provided. For example, a simple slit or round opening may be provided, or protruding structure, such as protrusions from one or both of the side edges of the finger 126 may be provided. While the distal end 124 of the finger 126 is illustrated as being coupled to the spine 128 at an adhesive 129, it will be appreciated, that in an imperfect practice of the invention, a distal portion of the finger may be coupled to a portion of the finger more proximal to the spine 128, yet not on the spine itself. This practice of the invention, however, would likewise fall under the claims and teachings of the invention.

Binding elements according to the invention may be fabricated of any appropriate material. In a currently preferred embodiment, nylon is utilized inasmuch as nylon is a flexible, yet very strong polymer. It will be appreciated, however, that alternate materials may be utilized. In another currently preferred embodiment, an oriented polyester material is utilized. Some examples of commercially available oriented polyesters include Hostaphan® available from Mitsubishi Plastics Inc. of Tokyo, Japan, Mylar® available from E.I. du Pont de Nemours and Company, and Dural-Lar™ available from Grafix Plastics of Cleveland, Ohio. Oriented polyester offers the advantage that it does not absorb moisture and can be used with known off-the-shelf adhesives. Additionally, oriented-strand or oriented polyesters provide good stiffness and spring-back characteristics, lay flat in their initial state as binding elements with little or no warping, and form a loop in the bound state that is more rounded and stronger (e.g., less likely to be crushed when bound) than binding elements made from other materials. By way of example only, and not limitation, the binding element may be fabricated of one or more materials such as polyethylene and polypropylene. Binding elements may be fabricated by any appropriate method. For example, they may be molded, extruded, or vacuum formed, stamped, laser cut or die cut, progressively or otherwise, from sheets of material.

Figure 22:
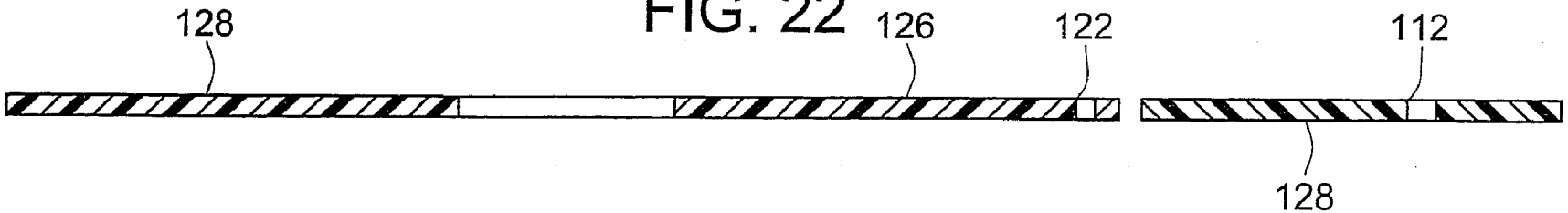
FIG. 22 is a cross-sectional view taken along line 22-22 in FIG. 21.

In accordance with another feature of the invention, a plurality of such binding elements may be fabricated with minimal waste when cut from a flat sheet of a material, such as nylon, Mylar-oriented polyester, or another appropriate plastic or other material. As explained with regard to the storage and shipment of the binding elements 50, pairs of binding elements 110 may be stamped from a sheet of material with the fingers alternately disposed (see FIGS. 21 and 22). Further, as shown in FIG. 16, the binding element 110 preferably comprises an odd number of fingers 126, and the recesses 118 are disposed at the base of every other finger 126. As a result, in stamping or otherwise fabricating a successive length of binding elements 110, a portion 132 may be removed from a strip of continuous binding elements between pairs of fingers 126 to provide recesses 118 that are spaced at alternate distances from the end of the spine 128, providing the varied spacing as illustrated in FIGS. 17 and 18.

With reference to FIGS. 26-32, yet another embodiment of a binding element 202 is illustrated. The binding element 202 is generally flat and includes a front surface 206 and a rear surface 210. Like the binding elements 50 shown in FIGS. 1-13 and the binding elements 110 shown in FIGS. 16-25, the binding element 202 is cut from a generally flat sheet 204 of material (e.g., nylon, an oriented-polyester material, or other suitable materials) having an outer or front surface 206*a* and an inner or rear surface 210*a* (see FIG. 28). As discussed in greater detail below, the sheet 204 of material may include any of a number of different coatings or layers on either side of the sheet 204 to impart certain properties or characteristics to the sheet 204 of material.

Figure 26:
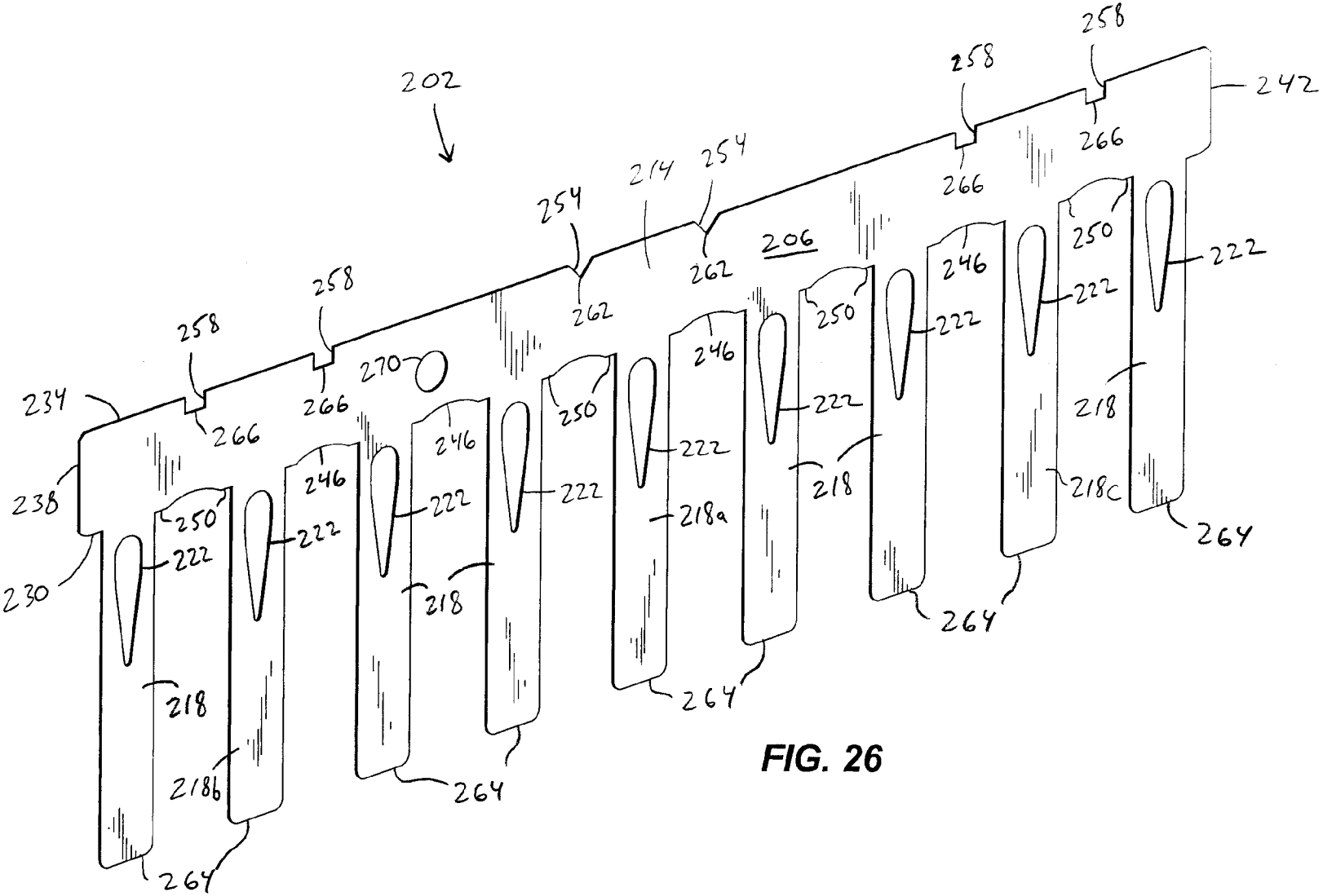
FIG. 26 is a front perspective view of another embodiment of a binding element constructed according to teachings of the invention.
Figure 27:
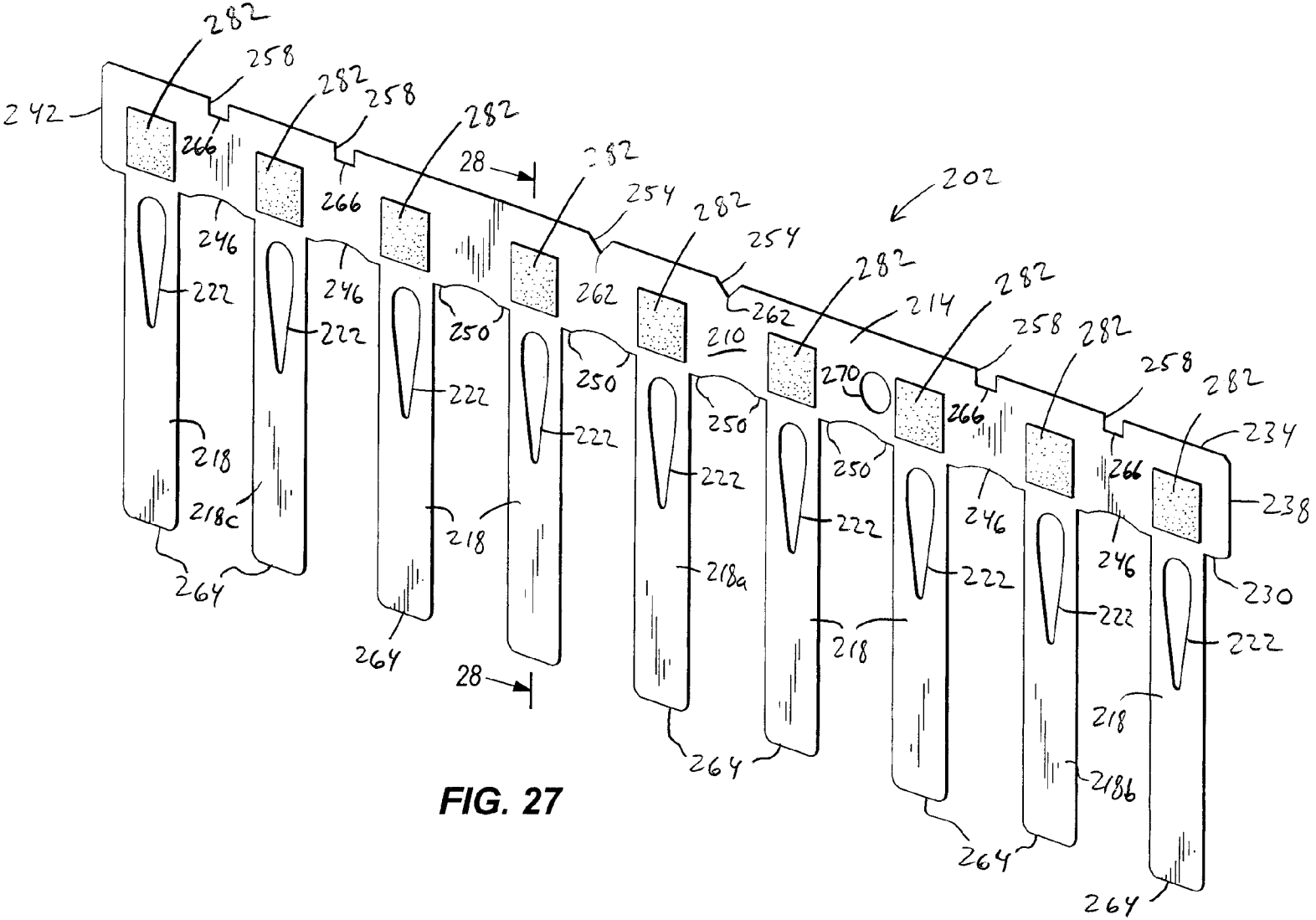
FIG. 27 is a rear perspective view of the binding element of FIG. 26, illustrating multiple areas of adhesive.

With reference to FIGS. 26 and 27, the binding element 202 includes a spine 214 and a plurality of fingers 218 extending from the spine 214. Like the fingers 126 in the binding element 50 of FIGS. 16-25, each of the fingers 218 includes a teardrop-shaped cutout 222 to allow the variation in bending stresses in the fingers 218 as discussed above. However, the fingers 218 in the binding element 202 of FIGS. 26-32 do not include the opening 122 that is engaged by the finger closing mechanism 130 (see FIG. 19). Rather, as discussed above, a suctioning device may be utilized to grasp one or more of the fingers 218 to initiate separation of a single binding element 202 from a stack 226 of binding elements 202 (see FIG. 31).

Figure 29:
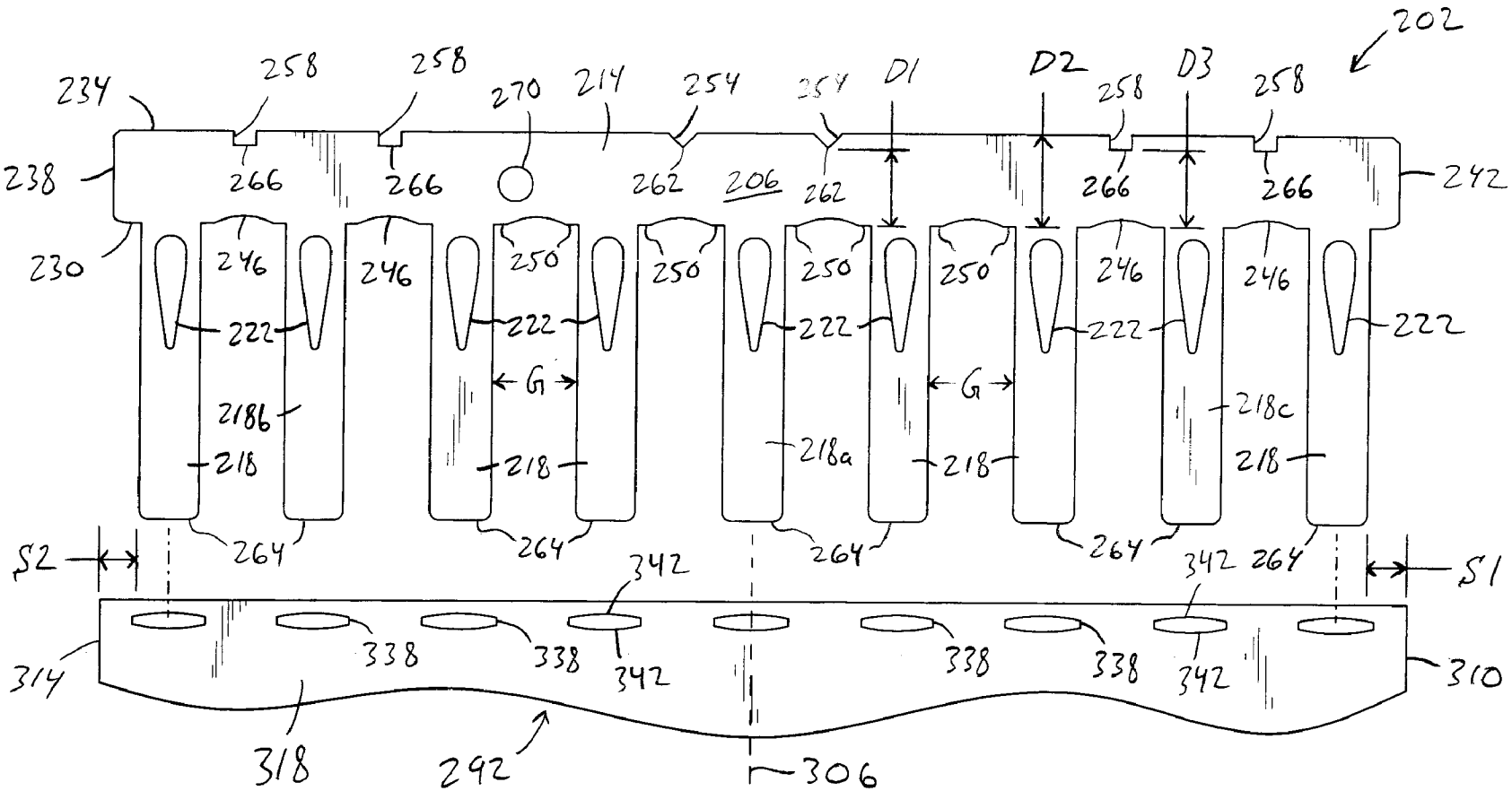
FIG. 29 is a top view of the binding element of FIG. 26 aligned with multiple perforations in a letter-sized sheet of material.
Figure 30:
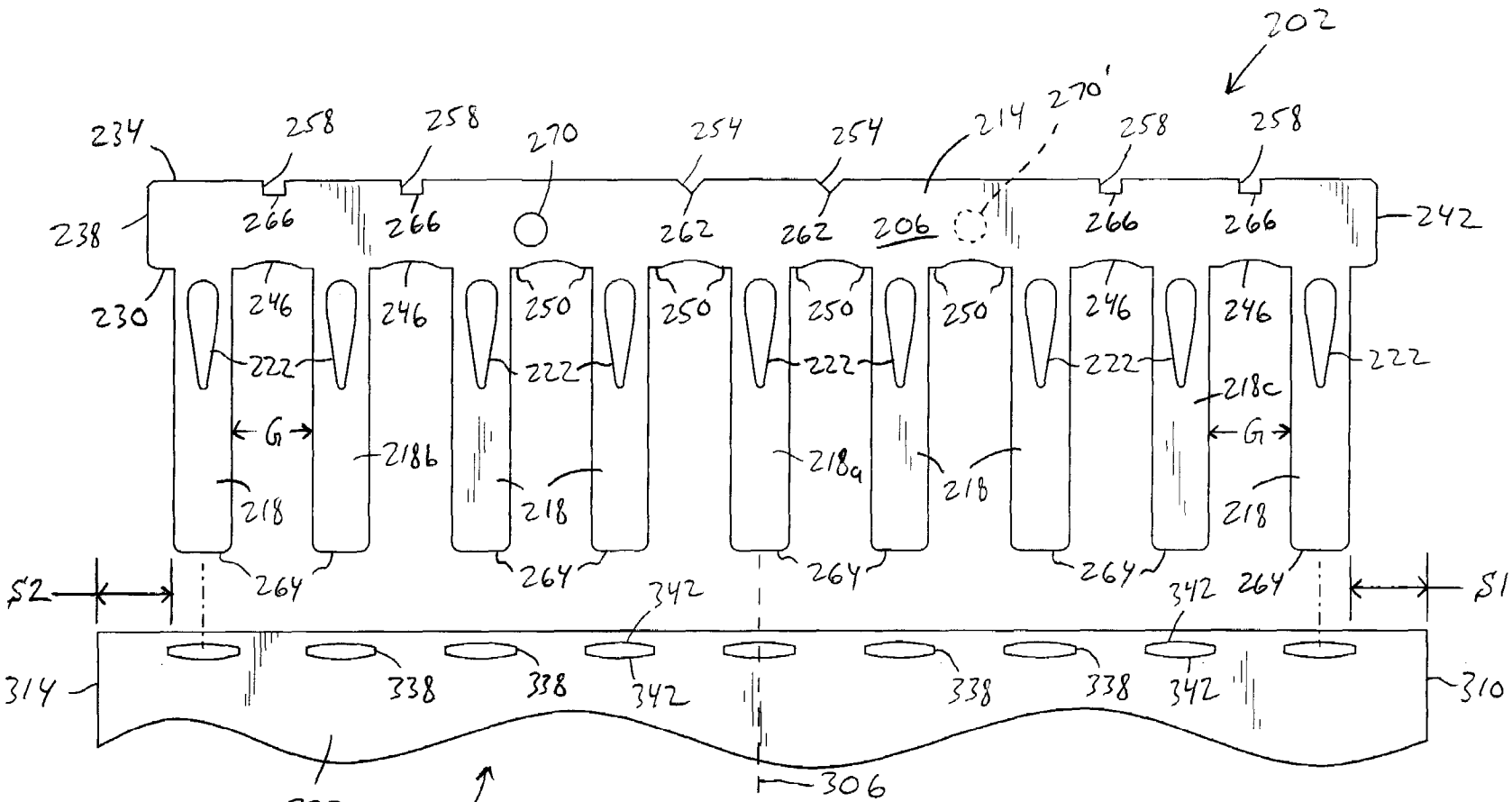
FIG. 30 is a top view of the binding element of FIG. 26 aligned with multiple perforations in an A4-sized sheet of material.

With reference to FIGS. 26 and 27, the spine 214 generally includes a first edge 230 from which the plurality of fingers 218 extend, a second edge 234 generally opposite the first edge 230, a third edge 238, and a fourth edge 242 generally opposite the third edge 238. In the illustrated construction of the binding element 202, the first edge 230 includes a plurality of scallops 246 and a plurality of shoulder portions 250 adjacent each of the plurality of fingers 218. Specifically, adjacent fingers 218 define a gap distance G therebetween, such that within the gap distance G, the first edge 230 includes a single scallop 246 and a shoulder portion 250 on opposite ends of the scallop 246 (see FIGS. 29 and 30). As shown in FIGS. 29 and 30, the shoulder portions 250 are generally parallel with the second edge 234 of the spine 214. In an alternative construction of the binding element 202, the scallop 246 may occupy substantially the entire length of the first edge 230 within the gap distance G between adjacent fingers 218.

With reference to FIGS. 26, 27, 29, and 30, the second edge 234 of the spine 214 includes a plurality of notches 254, 258 formed therein. In the illustrated construction of the binding element 202, both V-shaped notches 254 and U-shaped notches 258 are formed in the second edge 234 of the spine 214. In the illustrated construction of the binding element 202, the two V-shaped notches 254 are positioned on opposite sides of the middle or central finger 218*a* and are aligned within the gap distance G on either side of the central finger 218*a*. In alternate constructions of the binding element 202, more or fewer than two V-shaped notches 254 may be formed in the second edge 234 of the spine 214.

Each of the V-shaped notches 254 includes a distal end 262 inwardly spaced from the second edge 234 of the spine 214. As will be discussed in greater detail below, when the binding elements 202 are cut from the sheet 204 of material, a controlled dimension D1 is established between the distal ends 262 of the V-shaped notches 254 and a reference location on the binding element 202 (see FIG. 29). In the illustrated construction of the binding element 202, the controlled dimension D1 is established between the distal ends 262 of the V-shaped notches 254 and the shoulder portions 250 on the first edge 230 of the spine 214. The controlled dimension D1 may be different, for example, from an uncontrolled dimension D2 between the second edge 234 of the spine 214 and the shoulder portions 250 on the first edge 230 of the spine 214 in that the controlled dimension D1 may be held to a substantially tighter tolerance value than the uncontrolled dimension D2. For example, the controlled dimension D1 may be held to a tolerance of about 0.005", while the uncontrolled dimension D2 may be held to a tolerance of about 0.030". In an alternative construction of the binding element 202, the controlled dimension D1 may be established between the distal ends 262 of the V-shaped notches 254 and other reference locations on the binding element 202, such as respective distal ends 264 of the fingers 218.

With reference to FIGS. 26, 27, 29, and 30, the illustrated construction of the binding element 202 includes two pairs of U-shaped notches 258 positioned on opposite sides of the pair of V-shaped notches 254. Specifically, two U-shaped notches 258 are positioned, respectively, on opposite sides of the finger 218*b*, and are aligned within the gap distance G on either side of the finger 218*b*, adjacent the finger 218 closest to the third edge 238 of the spine 214. Additionally, two U-shaped notches 258 are positioned, respectively, on opposite sides of the finger 218*c*, and are aligned within the gap distance G on either side of the finger 218*c*, adjacent the finger 218 closest to the fourth edge 242 of the spine 214.

Each of the U-shaped notches 258 includes a distal end 266 inwardly spaced from the second edge 234 of the spine 214. As will be discussed in greater detail below, when the binding elements 202 are cut from the sheet 204 of material, a controlled dimension D3 is established between the distal ends 266 of the U-shaped notches 258 and a reference location on the binding element 202 (see FIG. 29). In the illustrated construction of the binding element 202, the controlled dimension D3 is established between the distal ends 266 of the U-shaped notches 258 and the shoulder portions 250 on the first edge 230 of the spine 214. Like the controlled dimension D1, the controlled dimension D3 may be held to a tolerance of about 0.005". In an alternative construction of the binding element 202, the controlled dimension D3 may be established between the distal ends 266 of the U-shaped notches 258 and other reference locations on the binding element 202, such as the distal ends 264 of the fingers 218.

Figure 34A:
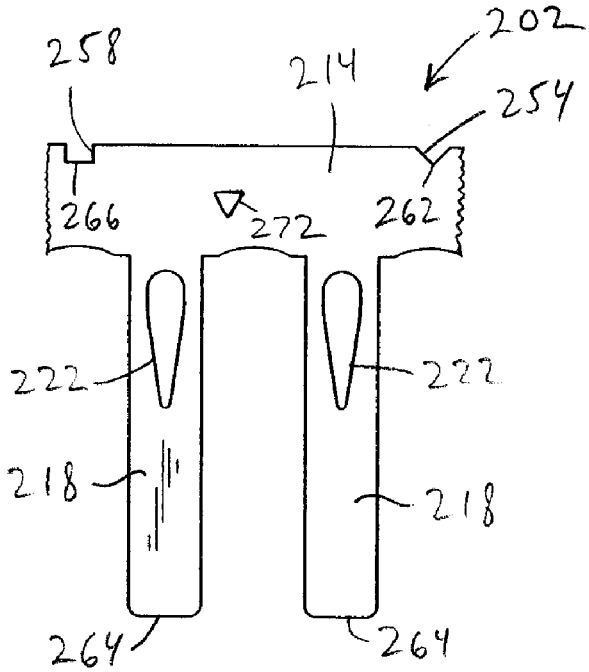
FIG. 34*a* is a partial top view of yet another embodiment of a binding element, illustrating an alignment aperture in a first orientation.
Figure 34B:
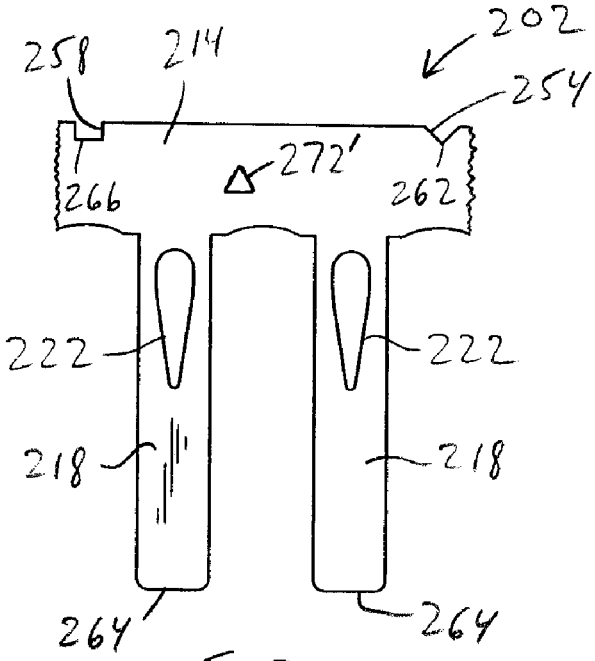
FIG. 34*b* is a partial top view of another embodiment of a binding element, illustrating an alignment aperture in a second orientation.

With reference to FIGS. 26, 27, and 29-32, the spine 214 also includes an alignment aperture 270 formed therein. As will be discussed in greater detail below, the aperture 270 may be formed in any location on the spine 214 within the boundary defined by the first edge 230, the second edge 234, the third edge 238, and the fourth edge 242 of the spine 214 (see the alternative location of aperture 270' in FIG. 30). In the illustrated construction of the binding element 202, however, the aperture 270 is positioned between one of the U-shaped notches 258 and one of the V-shaped notches 254, approximately equidistant from the first and second edges 230, 234 of the spine 214. Rather than providing a circular alignment aperture 270, the binding element 202 may include an alternatively-configured alignment aperture 272, such as the triangular alignment aperture 272 illustrated in FIG. 34*a*. As will be discussed in greater detail below, the alignment aperture 272 may be configured in any of a number of different ways (e.g., different shapes, different sizes, different orientations such as the orientation of the alignment aperture 272' in FIG. 34*b*) to serve as a brand-specific identifier of the binding elements 202.

Figure 28:
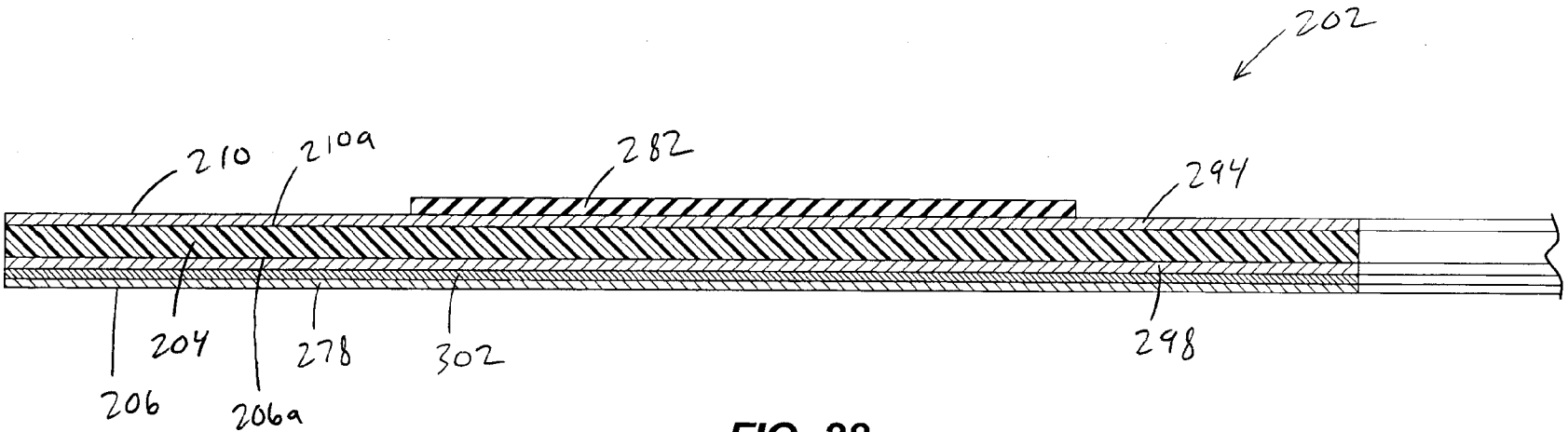
FIG. 28 is an enlarged, partial, cross-sectional view of the binding element of FIG. 26 through line 28-28 in FIG. 27, illustrating the component material layers of the binding element.

With reference to FIG. 28, an enlarged, partial, cross-sectional view of the binding element 202 is shown to illustrate the component layers of the binding element 202. As discussed above, a sheet 204 of nylon, Mylar-oriented polyester, or other suitable material is initially provided when manufacturing the binding elements 202. In the illustrated construction of the binding element 202, a layer of release coating 278 (e.g., silicone) is coupled to the front surface 206*a* of the sheet 204, while adhesive 282 is coupled to the rear surface 210*a* of the sheet 204. Rather than providing a single strip of adhesive across the spine 214, multiple and discrete areas or spots of adhesive 282 may be coupled to the rear surface 210*a* of the sheet 204, such that each of the plurality of fingers 218 is aligned with one of the multiple areas or spots of adhesive 282 on the spine 214 (see also FIG. 27). This construction of the binding element 202 allows multiple binding elements 202 to be stacked upon one another such that the adhesive 282 on one binding element 202 releasably attaches to the front surface 206 of another binding element 202. As discussed above, because the front surfaces 206 of the binding elements 202 include the layer of release coating 278, adhesive 282 from an attached binding element 202 is not likely to substantially stick to the front surface 206 of a binding element 202 when an adjacent element 202 is peeled away or separated.

With reference to FIG. 27, the same adhesive 282 on the binding elements 202 is also utilized to secure the distal ends 264 of the fingers 218 to the spine 214 when the binding element 202 is attached to a stack 292 of perforated sheets to bind the stack 292 (see FIGS. 29 and 30). Particularly, after the fingers 218 are bent and the gussets formed in the binding element 202, as described above and shown in the binding element 50 of FIGS. 23-25, the fingers 218 are looped around the stack 292 of perforated sheets such that the fingers 218 are attached to the spine 214 at the rear surface 210 of the binding element 202.

Figure 35A:
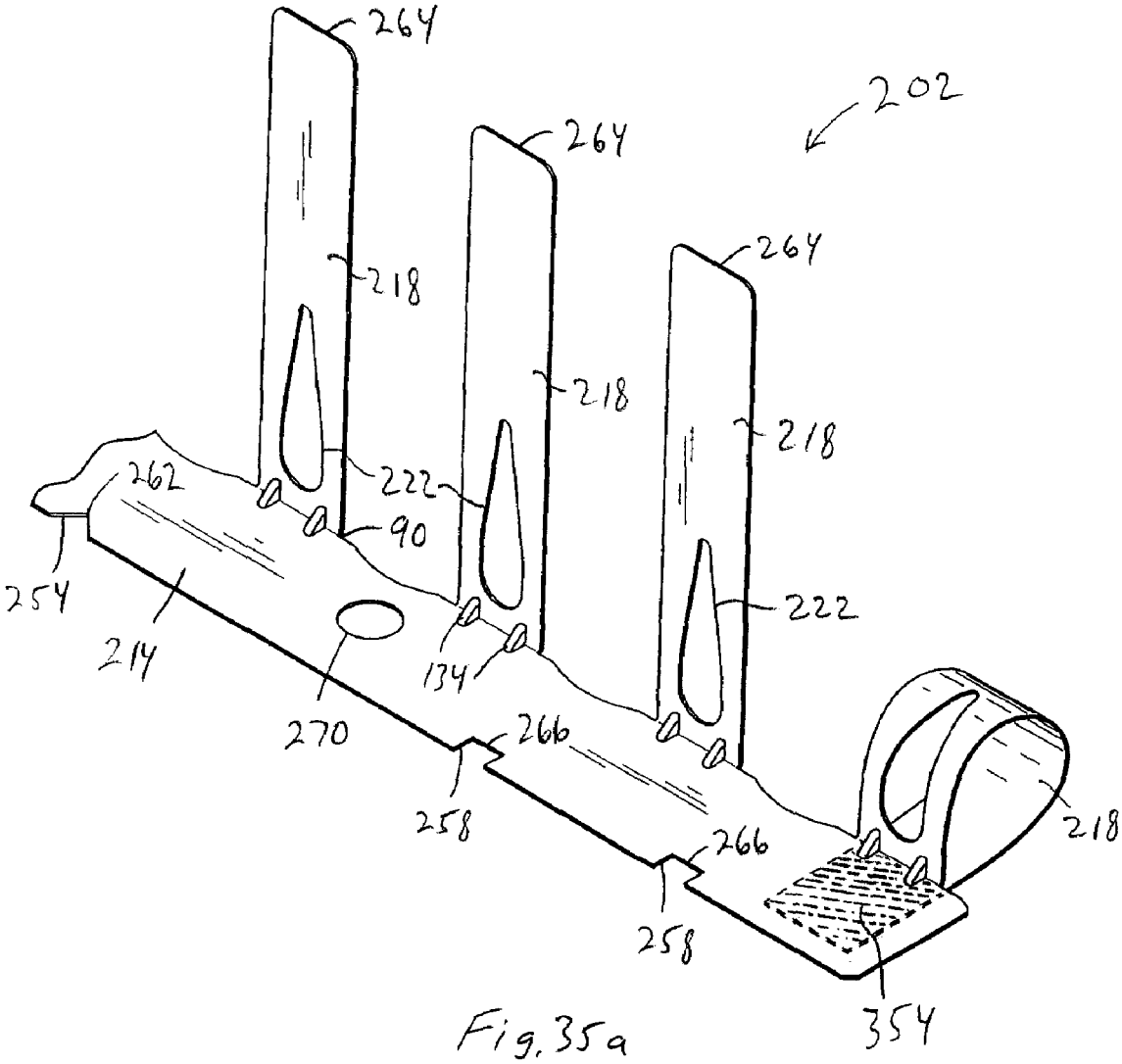
FIG. 35*a* is a front perspective view of the binding element of FIG. 26, illustrating one of the fingers of the binding element being welded to the spine of the binding element.
Figure 356:
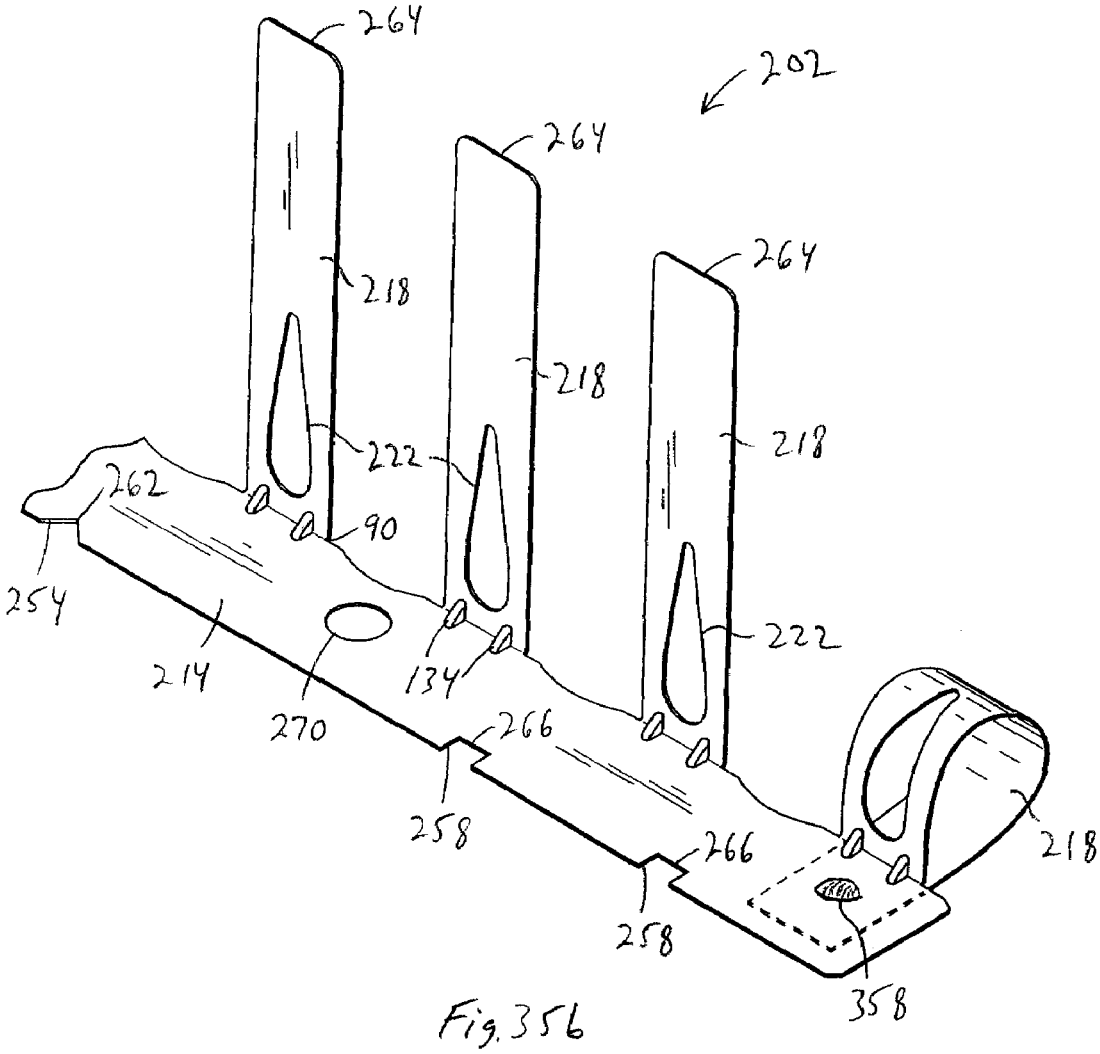
Figure 35C:
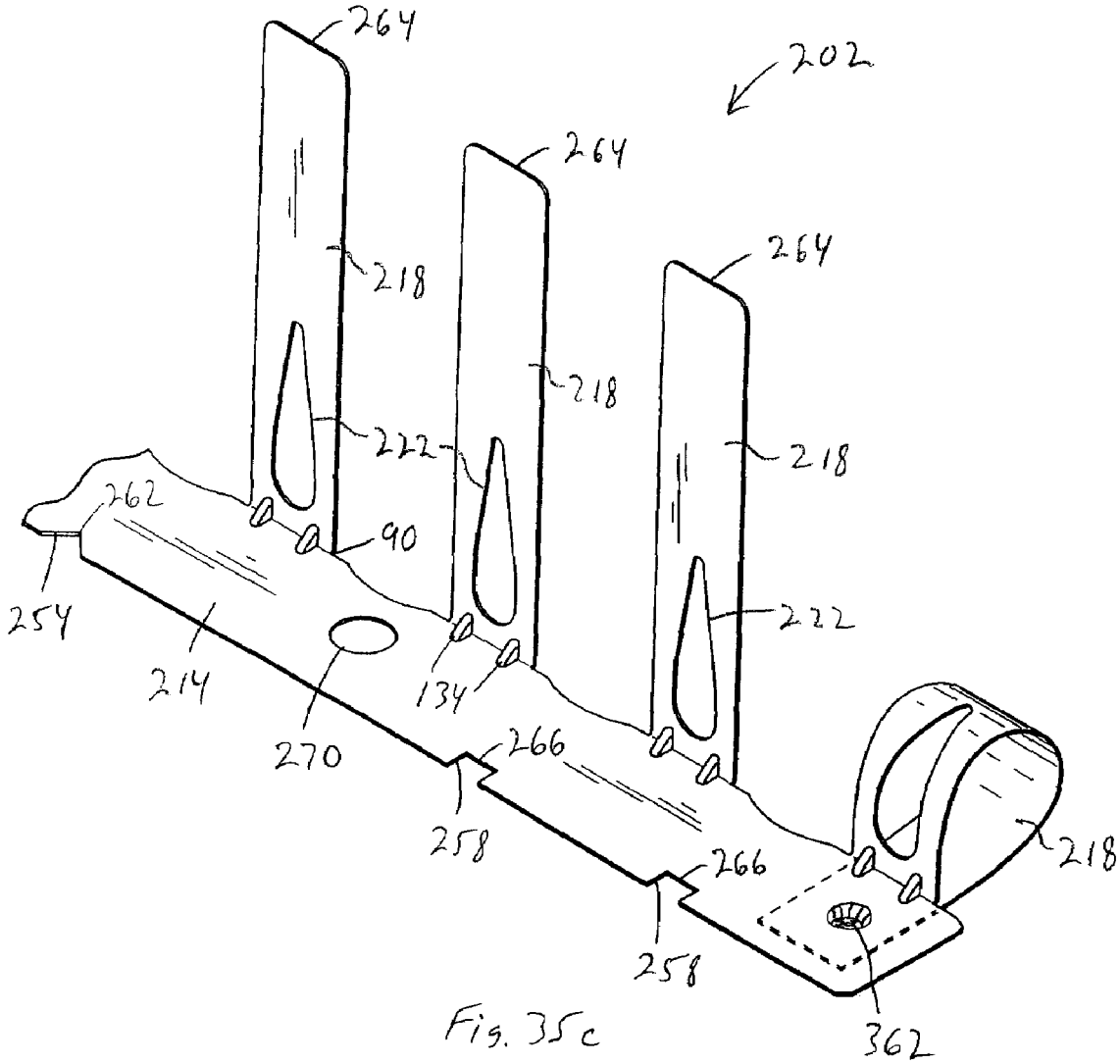
FIG. 35*c* is a front perspective view of the binding element of FIG. 26, illustrating one of the fingers of the binding element being deformably coupled to the spine of the binding element.

With reference to FIG. 35*a*, one of the fingers 218 of the binding element 202 is shown looped around and attached to the spine 214 at the rear surface 210 of the binding element 202. Rather than providing the adhesive 282 to attach the fingers 218 to the spine 214 of the binding element 202, a welding process (e.g., ultrasonic welding, RF-welding, friction welding, and so forth) may be utilized to secure the distal ends 264 of the fingers 218 to the spine 214 (see weld zone 354 in FIG. 35*a*). Alternatively, a mechanical fastener 358 (e.g., a rivet) may be utilized to secure the distal ends 264 of the fingers 218 to the spine 214 (see FIG. 35*b*). As yet another alternative, the distal ends 264 of the fingers 218 may be deformably coupled to the spine 214 (see FIG. 35*c*). In other words, after the distal ends 264 of the fingers 218 and the spine 214 are brought into contact, a male and female die set may be utilized to permanently deform portions of the fingers 218 and portions of the spine 214, resulting in a plurality of indentations 362 that secure the distal ends 264 of the respective fingers 218 to the spine 214.

With reference to FIG. 28, the illustrated construction of the binding element 202 utilizes a layer of primer 294 beneath the adhesive 282, and a layer of primer 298 beneath the layer of release coating 278. As discussed above, the layers of primer 294, 298 may increase the adhesion of the adhesive 282 to the sheet 204 and the adhesion of the layer of release coating 278 to the sheet 204, respectively. However, an alternative construction of the binding element 202 may utilize sufficiently tacky adhesive and release coating, such that the layers of primer 294, 298 on either side of the sheet 204 may be omitted.

With continued reference to FIG. 28, the illustrated binding element 202 includes a layer of coloring agent 302 coupled to the sheet 204 between the layer of primer 298 and the layer of release coating 278. The coloring agent (e.g., ink or dye) may be utilized to impart color to the sheet 204, which otherwise may be substantially clear or a non-desired color. If a sufficiently tacky coloring agent is utilized, the layer of primer 298 may be omitted. In alternative constructions of the binding element 202, the coloring agent may also be omitted to yield a substantially clear binding element 202 or a binding element 202 of the natural color of the sheet 204.

In an alternative construction of the binding element 202, the sheet 204 may be made from a material having natural release properties, such that the release coating 278 may be omitted. Such a material may include, among others, high-density polyethylene and polypropylene. In such a construction of the binding element 202, if the layer of coloring agent 302 is not utilized, the layer of primer 298 on the front surface 206*a* of the sheet 204 and the layer of release coating 278 may be omitted, leaving the layer of primer 294 on the rear surface 210*a* of the sheet 204 as the only applied treatment or coating on the sheet 204. Further, rather than providing the layer of primer 294 to increase the adhesion of the adhesive 282 to the sheet 204, alternative processes (e.g., abrading, corona treating, flame treating, etching, and others) may be utilized to treat the rear surface 210*a* of the sheet 204 to increase the adhesion properties of the rear surface 210*a* to promote the adhesion of the adhesive 282 to the rear surface 210*a*.

In manufacturing the binding elements 202, the layers of primer 294, 298, the layer of coloring agent 302, and the layer of release coating 278 are consecutively applied to the rear surface 210*a* of the sheet 204 of substrate material. In addition, the layer of primer 294 is applied to the front surface 206*a* of the sheet 204 of substrate material. The layers of primer 294, 298 and coloring agent 302 may be omitted as discussed above. Then, the sheet 204 of substrate material may be slit or cut into multiple narrow lengths of substrate material, in which each length of substrate material is approximately wide enough to cut two binding elements 202 therefrom (see the binding elements 110 in FIG. 21). Then, the individual binding elements 202 may be cut from the narrow lengths of substrate material using, for example, a progressive die-cutting or other suitable operation. The widths of the narrow lengths of substrate material need not be controlled to a relatively tight tolerance value because, as described above, the controlled dimensions D1, D3 are cut into each binding element 202 using the progressive die or other suitable cutting operation. Therefore, because the widths of the narrow lengths of substrate material may vary, the uncontrolled dimension D2 between the respective second edges 234 and the shoulder portions 250 of the respective binding elements 202 cut from the narrow lengths of substrate material may be substantially different from one binding element 202 to another.

After the individual binding elements 202 are cut, the adhesive 282 is applied to the rear surface 210 of the binding element 210. Particularly, the multiple areas or spots of adhesive 282 are applied to the spine 214 of the binding element 202 in locations aligned with the respective fingers 218 extending from the spine 214. In alternative constructions of the binding element 202, the multiple areas or spots of adhesive 282 may be applied to the fingers 218 rather than the spine 214.

After the adhesive 282 is applied to the binding elements 202, the binding elements 202 may be stacked upon one another to form a stack 226 of binding elements 202 (see FIG. 31), or a cartridge or cassette of binding elements 202 for placement in an automated binding machine, as described above with reference to the stacked binding elements 50 of FIG. 13. One or more of the notches 254, 258 and/or the aperture 270 in the spine 214 may be utilized to align the individual binding elements 202 to facilitate stacking of the binding elements 202 upon one another.

With reference to FIGS. 26, 27, and 29-32, the illustrated construction of the binding element 202 includes an odd number of fingers 218 such that an even number of fingers 218 is disposed on either side of the central finger 218*a*. With reference to FIGS. 29 and 30, the central finger 218*a* is substantially aligned with a mid-line 306 between a first edge 310 and a second edge 314 of the stack 292 of perforated sheets, thereby providing symmetry and a balanced appearance to the bound stack 292 of perforated sheets.

Specifically, the illustrated binding element 202 includes nine fingers 218, which are spaced from one another by a gap distance G of about 0.74", such that the binding element 202 may be utilized to bind stacks 292 of letter-sized (i.e., 8.5"× 11") perforated sheets 318 or A4-sized perforated sheets 322. Particularly, when using the binding element 202 to bind stacks 292 of either letter-sized perforated sheets 318 or A4-sized perforated sheets 322, an edge distance S1 between the first edge 310 of the stack 292 of perforated sheets and the finger 218 adjacent the fourth edge 242 of the spine 214 is less than or substantially equal to the gap distance G. Similarly, when using the binding element 202 to bind stacks 292 of either letter-sized perforated sheets 318 or A4-sized perforated sheets 322, an edge distance S2 between the second edge 314 of the stack 292 of perforated sheets and the finger 218 adjacent the third edge 238 of the spine 214 is less than or substantially equal to the gap distance G. Because the central finger 218*a* is aligned with the mid-line 306, the edge distance S1 is substantially equal to the edge distance S2. However, this need not be the case. Alternative constructions of the binding element 202 may include more or fewer than nine fingers 218, so long as the gap distance G is greater than or substantially equal to the edge distances S1, S2.

Figure 31:
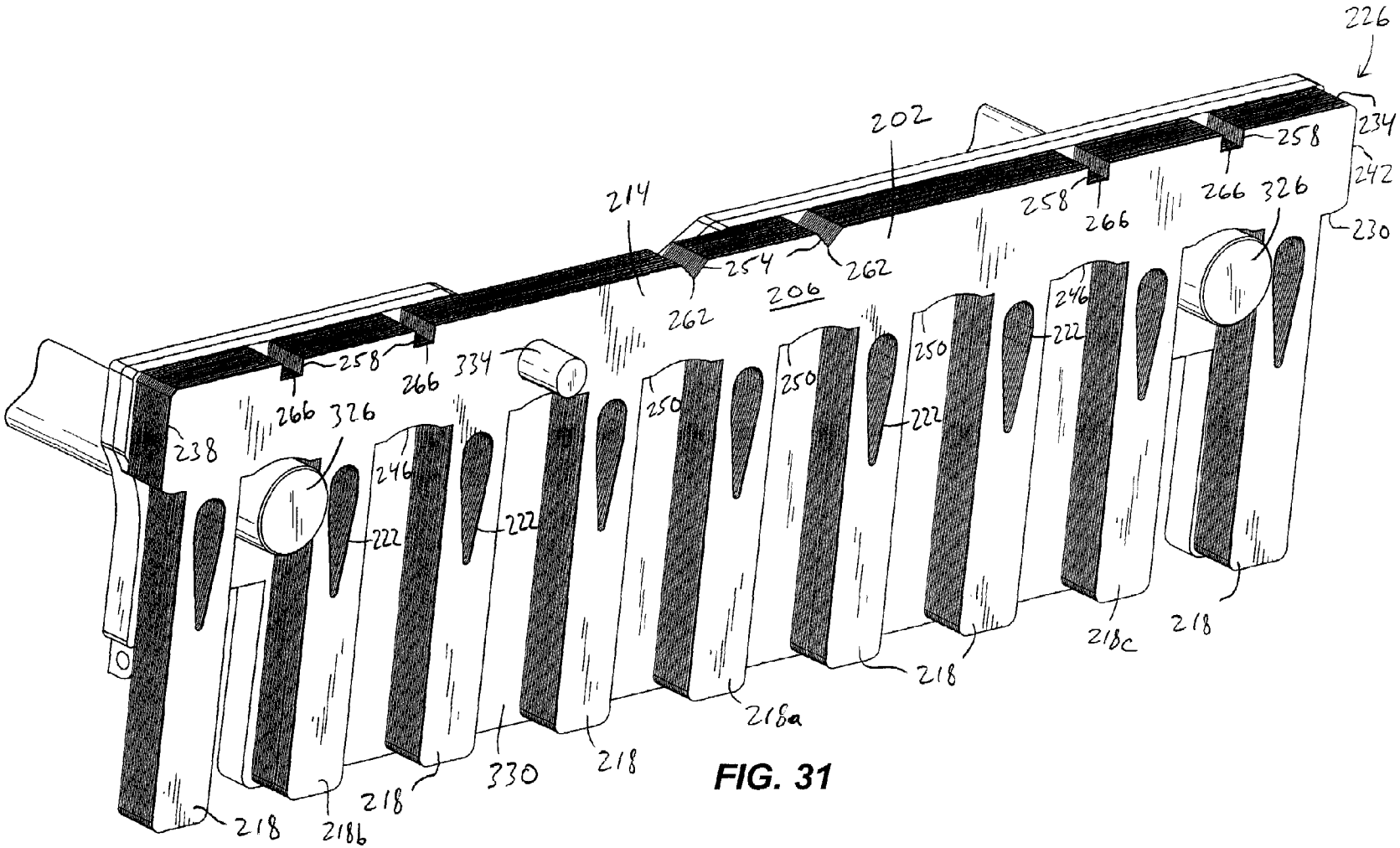
FIG. 31 is a front perspective view of a stack of binding elements of FIG. 26, illustrating an alignment member of an automated binding machine inserted through the stack of binding elements.

With reference to FIG. 31, the stack 226 of binding elements 202 is shown being supported by a portion of a binding element feeder mechanism of an automated binding machine. Particularly, the feeder mechanism includes a plurality of substantially round projections or rods 326 to support the stack 226 of binding elements 202 and a back plate 330 movable relative to the support rods 326 for advancing the stack 226 of binding elements 202 as individual binding elements 202 are peeled away or separated from the stack 226. As shown in FIG. 31, one or more scallops 246 in the binding elements 202 are in sliding contact with the support rods 326, which have a radius smaller than the radius of the scallops 246. As such, contact between the scallops 246 in the individual binding elements 202 and the support rods 326 occurs along only a small portion of the scallops 246, at a location where the support rods 326 and the scallops 246 are substantially tangent to one another. Therefore, the support rods 326 may also at least partially laterally align the stack 226 of binding elements 202 with respect to the feeder mechanism.

With continued reference to FIG. 31, the feeder mechanism may also include an alignment member or an alignment rod 334 extending through the respective apertures 270 of the individual binding elements 202 in the stack 226. Like the support rods 326, the alignment rod 334 may provide lateral or side-to-side alignment of the stack 226 of binding elements 202 in the feeder mechanism. However, the alignment rod 334 may also serve as a brand-specific identifier for the automated binding machine. In other words, one brand of automated binding machine may position the alignment rod 334 in the location shown in FIG. 31 so that a particular brand or supply of binding elements 202, which have apertures 270 in corresponding locations, must be utilized. Other brands or supplies of binding elements 202, having apertures (e.g., apertures 270' in FIG. 30) in different locations other than that shown in FIG. 31, would not be usable in the feeder mechanism of FIG. 31 because of the misalignment between the alignment rod 334 and the apertures 270' in the binding elements 202. Rather than relocating the alignment rod 334, different configurations (e.g., different shapes, sizes, and orientations) of the alignment rod can be used to distinguish between different brands of binding elements 202 (e.g., a triangular cross-sectional shape to receive triangular aperture 272, see FIG. 34*a*), and/or the alignment rod may be reoriented to receive brand-specific binding elements 202 (e.g., those binding elements 202 in FIG. 34*b* having the differently-oriented triangular alignment aperture 272').

Figure 32:
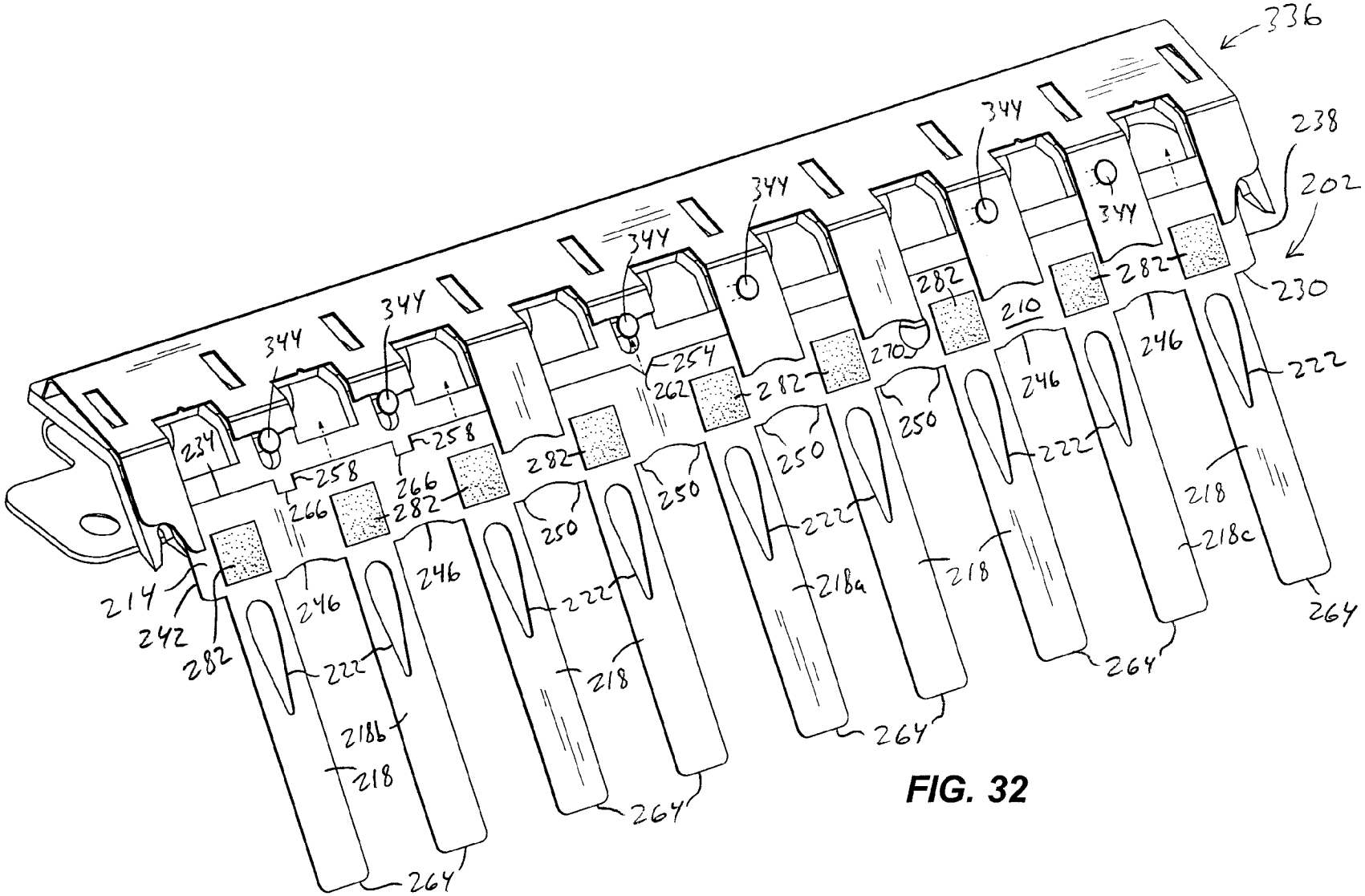
FIG. 32 is a perspective view of the binding element of FIG. 26, illustrating multiple registration notches of the binding element being engaged by respective registration members of an automated binding machine.
Figure 33:
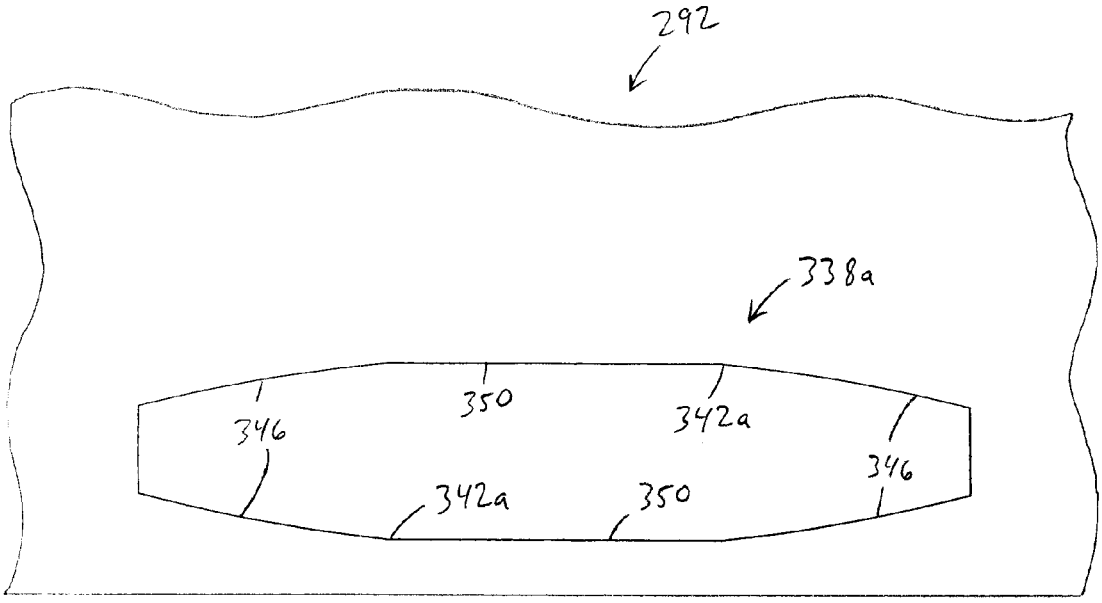
FIG. 33 is a partial top view of a stack of perforated sheets having an alternative configuration of perforations than those shown in FIGS. 29 and 30.

With reference to FIG. 32, an individual binding element 202 is shown after being peeled away or separated from the stack 226 of binding elements 202 in FIG. 31. A portion of a clamping mechanism or a receiving member 336 of the automated binding machine is configured to receive the individual binding element 202 from the stack 226 and insert the fingers 218 through respective perforations 338 in the stack 292 of perforated sheets (see also FIGS. 29 and 30). The stack 292 of perforated sheets is generated by a stacking mechanism (not shown), and the stack 292 of perforated sheets is supported in a tray (also not shown) below the clamping mechanism or receiving member 336. To facilitate stacking of the perforated sheets and alignment of the perforations 338 in the individual sheets in the stack 292, the perforations 338 may each include at least partially arcuate longitudinal edges 342 opposite one another (see FIGS. 29 and 30) generally forming what can be referred to as a "double-D" shaped perforation 338. As shown in FIGS. 29 and 30, substantially the entire length of the longitudinal edges 342 is arcuate. FIG. 33 illustrates an alternative construction of the double-D shaped perforation 338*a*, including longitudinal edges 342*a* having both arcuate portions 346 and substantially straight portions 350. As illustrated in FIG. 33, the substantially straight portions 350 are located intermediate the arcuate portions 346 on each of the longitudinal edges 342*a*. As a result of the double-D shape of the perforations 338, individual sheets, as they are being stacked and aligned, are less likely to become caught or hung up in the perforations 338 of an underlying sheet.

With reference to FIG. 32, portions of the receiving member 336 are shown for engaging the notches 254, 258 in the spine 214 of the individual binding element 202. Particularly, the receiving member 336 may include pins 346 configured to engage the respective V-shaped notches 254 to provide lateral or side-to-side alignment of the binding element 202 with respect to the perforations 338 in the stack 292 of perforated sheets. The receiving member 336 may also include other pins 346 configured to engage the respective U-shaped notches 258 to at least partially orient the fingers 218 for insertion through the perforations 338 in the stack 292 and to prevent pivoting of the binding element 202 about the pins 346 engaging the respective V-notches 254.

As discussed above, the controlled dimensions D1, D3 on the binding elements 202 allow individual binding elements 202 to be registered in the receiving member 336 by the pins 346 accurately and precisely. Further, knowing the thickness of the stack 292 of perforated sheets to be bound, the automated binding machine may accurately and precisely insert the fingers 218 of the binding element 202 through the perforations 338 to the required depth before looping the fingers 218 and securing the fingers 218 to the spine 214 via the adhesive 282 as described above and shown in FIGS. 2 and 23.

It will be appreciated by those of skill in the art that the particular design of the binding elements themselves may be of an alternate configuration than those disclosed in the illustrations herein. While this invention has been described with an emphasis upon preferred embodiments, variations of the preferred embodiments can be used, and it is intended that the invention can be practiced otherwise than as specifically described herein. Accordingly, this invention includes all modifications encompassed within the spirit and scope of the invention as defined by the following claims. For example, various aspects of the invention may be practiced simultaneously.

Various features of the invention are set forth in the following claims.

What is claimed is:

1. A stack of binding elements adapted for binding stacks of perforated sheets, the stack comprising:

a first binding element including a rear surface having an adhesive thereon;

front surface having a release coating thereon;

a spine; and a plurality of fingers extending from the spine;

wherein the adhesive on the rear surface includes multiple distinct areas of adhesive on the spine, each distinct area of adhesive being aligned with a respective one of the plurality of fingers;

a second binding element including a rear surface having an adhesive thereon;

a front surface having a release coating thereon;

a spine; and a plurality of fingers extending from the spine;

wherein the adhesive on the rear surface of the first binding element is positioned on the rear surface such that the adhesive (a) releasably attaches the first binding element to the front surface of the second binding element, and (b) attaches the plurality of fingers of the first binding element to the spine of the first binding element when the first binding element is separated from the second binding element and coupled to a stack of perforated sheets; and wherein the stack of binding elements is configured for use in an automated binding machine operable to separate the first and second binding elements from one another and couple the first binding element with a stack of sheets, and wherein each of the first and second binding elements further includes locating structure adapted to be engaged by at least one locating portion of the automated binding machine.

2. The stack of binding elements of claim 1, wherein the release coating includes a silicone coating.

3. The stack of binding elements of claim 1, wherein the release coating is applied over substantially the entire front surface of each of the first and second binding elements.

4. The stack of binding elements of claim 1, wherein each of the first and second binding elements further includes separating structure adapted to be engaged by at least one separating portion of an automated binding machine.

5. The stack of binding elements of claim 4, wherein the separating structure comprises at least one of a recess in and a protrusion from the binding element.

6. The stack of binding elements of claim 1, wherein the locating structure comprises at least one of an opening through, a recess in, and a protrusion from the binding element.

7. The stack of binding elements of claim 1, further comprising a plurality of additional binding elements substantially identical to the first and second binding elements and coupled together to form a single unit.

8. The stack of binding elements of claim 1, wherein at least one of the fingers of the first and second binding elements includes at least one of a living hinge, a scored line, and a bend.

9. The stack of binding elements of claim 1, wherein at least one of the fingers of the first and second binding elements includes a bend and at least one gusset disposed along the bend.

10. The stack of binding elements of claim 1, wherein each of the plurality of fingers of each of the first and second binding elements includes a substantially teardrop-shaped enclosed aperture that substantially distributes stresses along the length of the finger to avoid concentration of bending forces along a length of the finger when the finger is formed into a closed loop.

11. The stack of binding elements of claim 1, wherein each of the first and second binding elements includes a layer of primer on the rear surface beneath the adhesive.

12. The stack of binding elements of claim 1, wherein the front surface of each of the first and second binding elements further includes at least one of a layer of primer and a layer of coloring agent thereon.

13. The stack of binding elements of claim 12, wherein the front surface of each of the first and second binding elements includes a layer of primer beneath the release coating.

14. The stack of binding elements of claim 12, wherein the front surface of each of the first and second binding elements includes a layer of primer beneath a layer of coloring agent.

15. The stack of binding elements of claim 12, wherein the front surface of each of the first and second binding elements includes a layer of coloring agent beneath the release coating.

16. The stack of binding elements of claim 1, wherein no removable backing strip is present between the adhesive and the second binding element.

17. The stack of binding elements of claim 1, wherein the spine of each binding element includes a first edge from which the plurality of fingers extend, and wherein the first edge includes a scallop between adjacent fingers of the plurality of fingers.

18. The stack of binding elements of claim 17, wherein the first edge of each binding element further includes a shoulder portion adjacent each finger such that there are two shoulder portions and one scallop between adjacent fingers of the plurality of fingers.

19. The stack of binding elements of claim 1, wherein adjacent fingers of the plurality of fingers of each binding element are spaced apart by a gap distance G, wherein each binding element can be used to bind either a stack of standard letter-sized sheets or a stack of standard A4-sized sheets, and wherein a distance S1 between a first end finger of the plurality of fingers and an edge of the stack of sheets adjacent the first end finger is substantially equal to or less than the gap distance G, and a distance S2 between a second end finger of the plurality of fingers and an edge of the stack of sheets adjacent the second end finger is substantially equal to or less than the gap distance G, regardless of whether the binding element is used to bind a stack of standard letter-sized sheets or a stack of standard A4-sized sheets.

20. The stack of binding elements of claim 19, wherein the gap distance G is about 0.74 inches.

21. The stack of binding elements of claim 19, wherein there are nine fingers in the plurality of fingers for each binding element.

22. The stack of binding elements of claim 1, wherein the spine of each binding element includes a first edge from which the plurality of fingers extend and a second edge opposite the first edge, and wherein the locating structure includes at least one V-shaped notch formed in the second edge of each binding element.

23. The stack of binding elements of claim 22, wherein the at least one V-shaped notch includes a distal end, and wherein a controlled dimension D1 is defined between the distal end of the V-shaped notch and a reference location on the respective binding element, the controlled dimension D1 being held to a tolerance of about 0.005 inches during manufacturing.

24. The stack of binding elements of claim 22, wherein there are two V-shaped notches on the second edge of each binding element, one on each side of a central finger of the plurality of fingers.

25. The stack of binding elements of claim 23, wherein the reference location is on the first edge.

26. The stack of binding elements of claim 23, wherein the reference location is a distal end of one of the plurality of fingers.

27. The stack of binding elements of claim 1, wherein the spine of each binding element includes a first edge from which the plurality of fingers extend and a second edge opposite the first edge, and wherein the locating structure includes at least one U-shaped notch formed in the second edge of each binding element.

28. The stack of binding elements of claim 27, wherein the at least one U-shaped notch includes a distal end, and wherein a controlled dimension D3 is defined between the distal end of the U-shaped notch and a reference location on the respective binding element, the controlled dimension D3 being held to a tolerance of about 0.005 inches during manufacturing.

29. The stack of binding elements of claim 27, wherein there are four U-shaped notches on the second edge, two on each side of a central finger of the plurality of fingers.

30. The stack of binding elements of claim 28, wherein the reference location is on the first edge.

31. The stack of binding elements of claim 28, wherein the reference location is a distal end of one of the plurality of fingers.

32. The stack of binding elements of claim 1, wherein the spine of each binding element includes a first edge from which the plurality of fingers extend and a second edge opposite the first edge, and wherein the locating structure includes at least one U-shaped notch formed in the second edge of each binding element, at least one V-shaped notch formed in the second edge of each binding element at a location spaced from the U-shaped notch, and at least one aperture in the spine and distinct from the notches.

33. The stack of binding elements of claim 32, wherein there are two V-shaped notches, one on each side of a central finger of the plurality of fingers, wherein there are two pairs of U-shaped notches, one pair on each side of the two V-shaped notches, and wherein there is one aperture distinct from the notches, the aperture located between one of the U-shaped notches and one of the V-shaped notches.

34. The stack of binding elements of claim 32, wherein the aperture is circular in shape to receive a cylindrical alignment rod of the automated binding machine.

35. The stack of binding elements of claim 32, wherein each of the at least one U-shaped notch, the at least one V-shaped notch, and the at least one aperture are positioned between adjacent fingers of the plurality of fingers.

* * * * *